US008061778B2

(12) United States Patent
Machael et al.

(10) Patent No.: US 8,061,778 B2
(45) Date of Patent: Nov. 22, 2011

(54) ADJUSTABLE ARM FOR CHAIR

(75) Inventors: Jay R. Machael, Muscatine, IA (US); Jesse Hahn, Cedar Rapids, IA (US); John Robert Koch, Muscatine, IA (US); Todd Ireland, Coopersville, MI (US); Brett Kooistra, Grand Haven, MI (US)

(73) Assignee: HNI Technologies Inc., Muscatine, IA (US)

( * ) Notice: Subject to any disclaimer, the term of this patent is extended or adjusted under 35 U.S.C. 154(b) by 126 days.

(21) Appl. No.: 12/048,111

(22) Filed: Mar. 13, 2008

(65) Prior Publication Data

US 2008/0309141 A1 Dec. 18, 2008

Related U.S. Application Data

(60) Provisional application No. 60/894,655, filed on Mar. 13, 2007.

(51) Int. Cl.
*A47C 7/54* (2006.01)
*B60N 2/46* (2006.01)

(52) U.S. Cl. ..... 297/411.37; 297/411.36; 297/411.35

(58) Field of Classification Search ..... 297/411.35–411.37; 248/418, 124.2; 188/300
See application file for complete search history.

(56) References Cited

U.S. PATENT DOCUMENTS 5,590,934 A * 1/1997 Gibbs ..... 297/411.38
5,634,537 A 6/1997 Thorn
5,927,811 A 7/1999 Tseng
5,971,484 A 10/1999 Lamart et al.
5,984,416 A * 11/1999 Waldo et al. ..... 297/411.38
6,017,091 A * 1/2000 Cao ..... 297/411.37
6,059,366 A 5/2000 Hu
6,213,556 B1 4/2001 Chen
6,572,195 B1 6/2003 Lee
6,592,085 B2 7/2003 Iwata et al.
6,802,566 B2 10/2004 Prince et al.

(Continued)

FOREIGN PATENT DOCUMENTS

DE 29809099 U1 7/1999

(Continued)

OTHER PUBLICATIONS

International Search Report and Written Opinion for PCT/US2008/056893 of HNI Technologies Inc., mailed Jul. 17, 2008.

(Continued)

*Primary Examiner* — David Dunn
*Assistant Examiner* — Tania Abraham
(74) *Attorney, Agent, or Firm* — Faegre & Benson LLP

(57) ABSTRACT

A chair arm adjustment device according to embodiments of the present invention includes an arm pad base slidably coupled to the arm support, the arm pad base sliding substantially horizontally in two degrees of freedom with respect to the arm support within a range of motion of the arm pad base with respect to the arm support, and an arm brake assembly coupled with the arm pad base, the arm brake assembly moveable between a locked position in which the arm brake assembly substantially inhibits movement of the arm pad base relative to the arm support and an unlocked position in which the arm brake assembly does not substantially inhibit movement of the arm pad base relative to the arm support, wherein the arm brake assembly moves from the unlocked position to the locked position at any position of the arm pad base within the range of motion.

18 Claims, 34 Drawing Sheets

U.S. PATENT DOCUMENTS

| | | | | |
|---|---|---|---|---|
| 6,908,158 | B2 * | 6/2005 | Willette et al. | 297/411.37 |
| 6,969,116 | B2 | 11/2005 | Machael et al. | |
| 6,974,189 | B2 | 12/2005 | Machael et al. | |
| 6,994,400 | B2 | 2/2006 | Koepke et al. | |
| 7,066,538 | B2 | 6/2006 | Machael et al. | |
| 7,066,546 | B2 | 6/2006 | Trego et al. | |
| 2002/0036422 | A1 | 3/2002 | Prince et al. | |
| 2003/0178882 | A1 * | 9/2003 | Schmitz et al. | 297/411.36 |
| 2005/0146192 | A1 | 7/2005 | Trego et al. | |
| 2005/0146195 | A1 | 7/2005 | Machael et al. | |
| 2006/0006723 | A1 * | 1/2006 | Diffrient | 297/411.35 |
| 2006/0250018 | A1 | 11/2006 | Tsai | |
| 2009/0033139 | A1 | 2/2009 | Machael et al. | |

FOREIGN PATENT DOCUMENTS

| | | | |
|---|---|---|---|
| EP | 0958765 | B1 | 7/2003 |

OTHER PUBLICATIONS

Letter from Michael Pollner of Knoll, Inc. to Steven Bradford of HNI Corporation, Sep. 19, 2008 (5 pages).

Letter from Steven Bradford of HNI Corporation to Michael Pollner of Knoll, Inc., Sep. 26, 2008 (2 pages).

* cited by examiner

ADJUSTABLE ARM FOR CHAIR

CROSS-REFERENCE TO RELATED APPLICATIONS

This application claims the benefit of U.S. Provisional Patent Application Ser. No. 60/894,655, filed on Mar. 13, 2007, and entitled, "Adjustable Arm for Chair," which is incorporated by reference herein in its entirety.

TECHNICAL FIELD

Embodiments of the present invention relate generally to office furniture, and more specifically to an adjustable arm for an office chair.

BACKGROUND

Current adjustable arms often require a high degree of force to activate a button which permits movement of the arm pad; often, such force has a level of magnitude at or above the force required to move the arm pad. Often, adjustable chair arms do not permit arm pad movement in both side to side and forward to backward directions in the horizontal plane, or often require separate buttons to be activated to move the arm pad in different directions in the same horizontal plane. Adjustable chair arms which do offer adjustment often do not permit subsequent locking in an infinite number of selectable positions. In addition, current adjustable arms often do not permit horizontal translation in more than one non-parallel direction, swiveling in the horizontal plane, and also vertical height adjustment. Buttons for controlling adjustable arms are often not located near to each other or in a location easily accessible for a user seated in the chair.

SUMMARY

A chair arm adjustment device according to embodiments of the present invention includes an arm support, an arm pad base slidably coupled to the arm support, the arm pad base configured to slide substantially horizontally in two degrees of freedom with respect to the arm support within a range of motion of the arm pad base with respect to the arm support, and an arm brake assembly coupled with the arm pad base. The arm brake assembly is moveable between a locked position in which the arm brake assembly substantially inhibits movement of the arm pad base with respect to the arm support and an unlocked position in which the arm brake assembly does not substantially inhibit movement of the arm pad base with respect to the arm support, and the arm brake assembly is operable to move from the unlocked position to the locked position at any position of the arm pad base within the range of motion, according to embodiments of the present invention. A width slider may be slidably coupled to the arm support and configured to slide back and forth substantially horizontally with respect to the arm support along a first direction, and the arm pad base may be slidably coupled to the width slider, the arm pad base configured to slide back and forth substantially horizontally with respect to the width slider along a second direction different from (and in some cases perpendicular to) the first direction.

According to some embodiments of the present invention, a biasing element may be included to push the arm brake assembly toward the arm support. In some cases, the biasing element may be one or more springs. Some embodiments of the present invention may further include a brake lifter with a ramp opening, the ramp opening including a ramp. In such cases, the arm brake assembly may includes a post protruding through the ramp opening, such that sliding the brake lifter in a substantially horizontal direction raises the post along the ramp to move the arm brake assembly from the locked position to the unlocked position. A spring may bias the arm brake assembly toward the locked position. According to some embodiments of the present invention, an arm link is pivotably coupled to the arm pad base at a first pivot axis, a button link including a button is pivotably coupled to the arm link at a second pivot axis and pivotably coupled to the brake lifter at a third pivot axis, such that pushing the button widens an angle formed by the first, second, and third pivot axes to slide the brake lifter in the substantially horizontal direction. Embodiments of the present invention may further include arm base about which the arm support pivots; for example, the arm support may pivot about the arm base through two or more discrete pivot angles. In some cases, the arm brake assembly contacts the arm support in the locked position but not in the unlocked position.

A chair arm adjustment device according to embodiments of the present invention includes an arm base, an arm support pivotably coupled to the arm base, a slider slidably coupled to the arm support, the slider configured to slide substantially horizontally along a first direction, and an arm pad base slidably coupled to the slider. The arm pad base may be configured to slide substantially horizontally along a second direction with respect to the slider (the second direction substantially perpendicular to the first direction), and the arm pad base may be configured to slide substantially horizontally simultaneously in the first and second directions with respect to the arm support. Such embodiments may further include an arm brake assembly coupled with the arm pad base, the arm brake assembly moveable between a locked position in which the arm brake assembly substantially inhibits sliding of the arm pad base with respect to the arm support and an unlocked position in which the arm brake assembly does not substantially inhibit sliding of the arm pad base with respect to the arm support, wherein the arm brake assembly is operable to move from the unlocked position to the locked position at an infinite number of positions of the arm pad base with respect to the arm support. According to some embodiments of the present invention, the arm pad base slides with respect to the arm support within a range of motion, and the arm brake assembly is operable to move from the unlocked position to the locked position in an infinite number of positions of the arm pad base with respect to the arm support within the range of motion.

A chair arm adjustment device according to other embodiments of the present invention includes an arm support, an arm pad base coupled to the arm support, the arm pad base moveable with respect to the arm support in any direction along a plane, and an arm brake assembly coupled with the arm pad base, the arm brake assembly moveable between a locked position in which the arm brake assembly interferes with the arm support to substantially inhibit sliding of the arm pad base with respect to the arm support and an unlocked position in which the arm brake assembly does not substantially interfere with sliding of the arm pad base with respect to the arm support, wherein the arm brake assembly is operable to move from the unlocked position to the locked position at an infinite number of positions of the arm pad base with respect to the arm support. The arm pad may be coupled to the arm support by a slider. Such embodiments of a chair arm adjustment device may further include a button, a brake lifter with a ramp opening with at least one ramp, wherein the arm brake assembly includes a post extending through the ramp opening and wherein sliding the brake lifter raises the post along the ramp to move the arm brake assembly from the locked position to the unlocked position, and a means for sliding the brake lifter in response to a push of the button. Other embodiments of a chair arm adjustment device may include a brake lifter with a ramp opening with at least one ramp, wherein the arm brake assembly includes a post extending through the ramp opening and wherein sliding the brake lifter raises the post along the ramp to move the arm brake assembly from the locked position to the unlocked position, a button linkage with a button, the button linkage pivotably coupled to the brake lifter at a first pivot point, and an arm linkage pivotably coupled to the button linkage at a second pivot point and pivotably coupled to the arm pad base at a third pivot point, wherein an obtuse angle is formed by the first, second, and third pivot points such that pushing the button slides the brake lifter. Embodiments of the present invention may further include an arm base about which the arm support pivots.

A chair arm adjustment device according to yet other embodiments of the present invention includes an arm support, an arm pad base coupled to the arm support, the arm pad base moveable with respect to the arm support in any direction along a plane, an arm brake assembly coupled with the arm pad base, the arm brake assembly moveable between a locked position in which the arm brake assembly interferes with the arm support to substantially inhibit sliding of the arm pad base with respect to the arm support and an unlocked position in which the arm brake assembly does not substantially inhibit sliding of the arm pad base with respect to the arm support, wherein movement of the arm brake from the locked position to the unlocked position is a substantially vertical movement, an arm brake lifter, wherein sliding the arm brake lifter substantially horizontally moves the arm brake from the locked position to the unlocked position, and a button linkage assembly pivotably coupled to the arm brake lifter and to the arm pad base, the button linkage assembly comprising a button, wherein pushing the button causes the button linkage assembly to slide the brake lifter, and wherein an amount of force to depress the button decreases as the arm brake moves from the locked position to the unlocked position. According to such embodiments of the present invention, the arm brake assembly may be operable to move from the unlocked position to the locked position at an infinite number of positions of the arm pad base with respect to the arm support.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
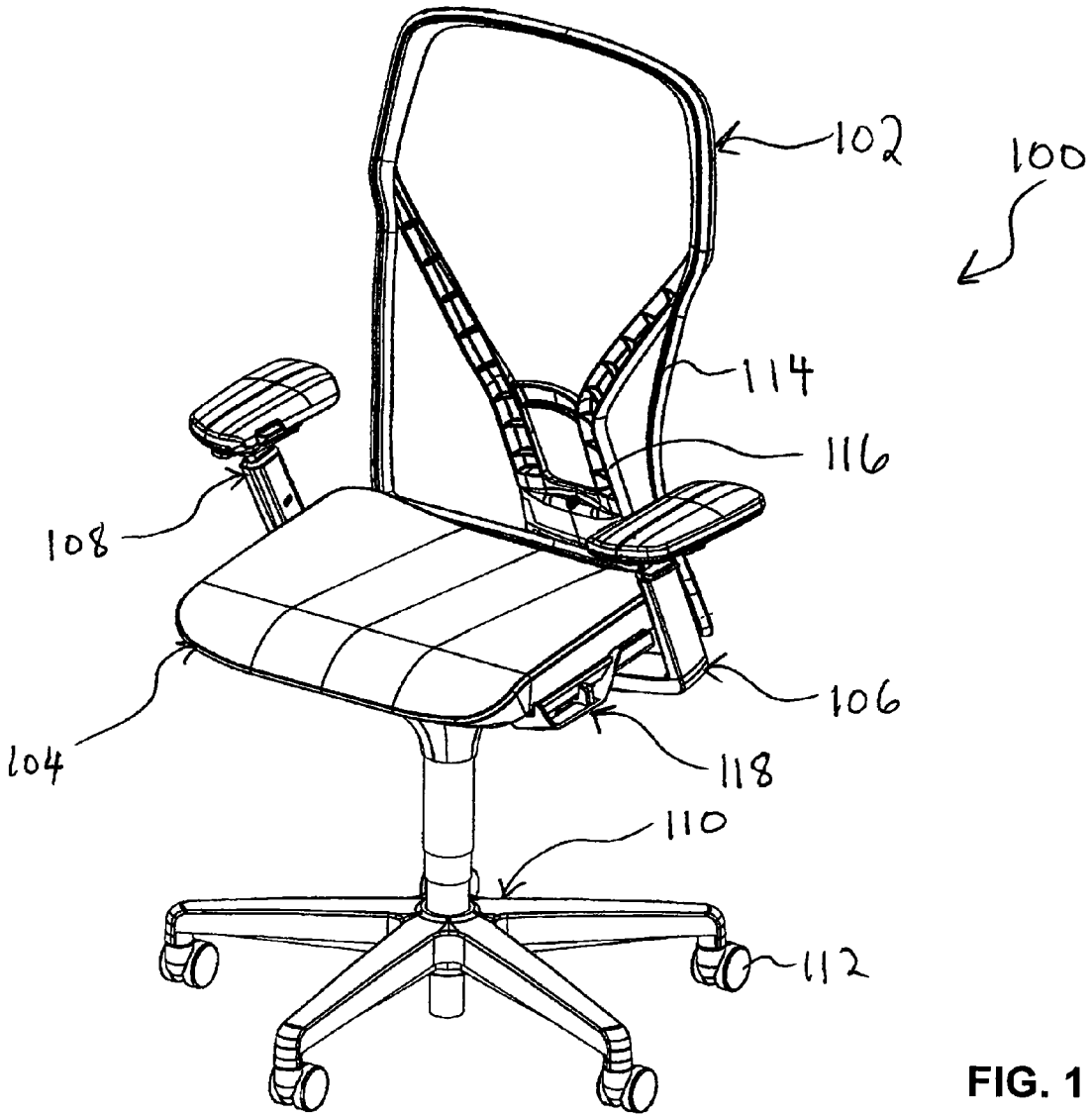
FIG. 1 illustrates a front perspective view of a chair according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention relate generally to office furniture, and more specifically to an adjustable arm for an office chair. FIGS. 1-7 depict an office chair 100 according to embodiments of the present invention. Chair 100 includes a back 102, a seat 104, a left arm 106, a right arm 108, and a base pedestal 110. Seat 104 and back 102 of chair 100 rotate about base pedestal 110, and casters 112 or wheels may be coupled to base pedestal 110 to contact an underlying surface (such as, for example, a floor), according to embodiments of the present invention. Back 102 may include a support member 116 and a covering (not shown) made of mesh, fabric, or the like which is coupled to back 102 along outer frame 114 and against which a user's back would rest.

As used herein, the term "coupled" is used in its broadest sense to refer to elements which are connected, attached, and/or engaged, either directly or integrally or indirectly via other elements, and either permanently, temporarily, or removably. As used herein, the term "swivelably coupled" is used in its broadest sense to refer to elements which are coupled in a way that permits one element to swivel with respect to another element. As used herein, the terms "rotatably coupled" and "pivotably coupled" are used in their broadest sense to refer to elements which are coupled in a way that permits one element to rotate or pivot with respect to another element. As used herein, the term "slidably coupled" is used in its broadest sense to refer to elements which are coupled in a way that permits one element to slide or translate with respect to another element.

Figure 2:
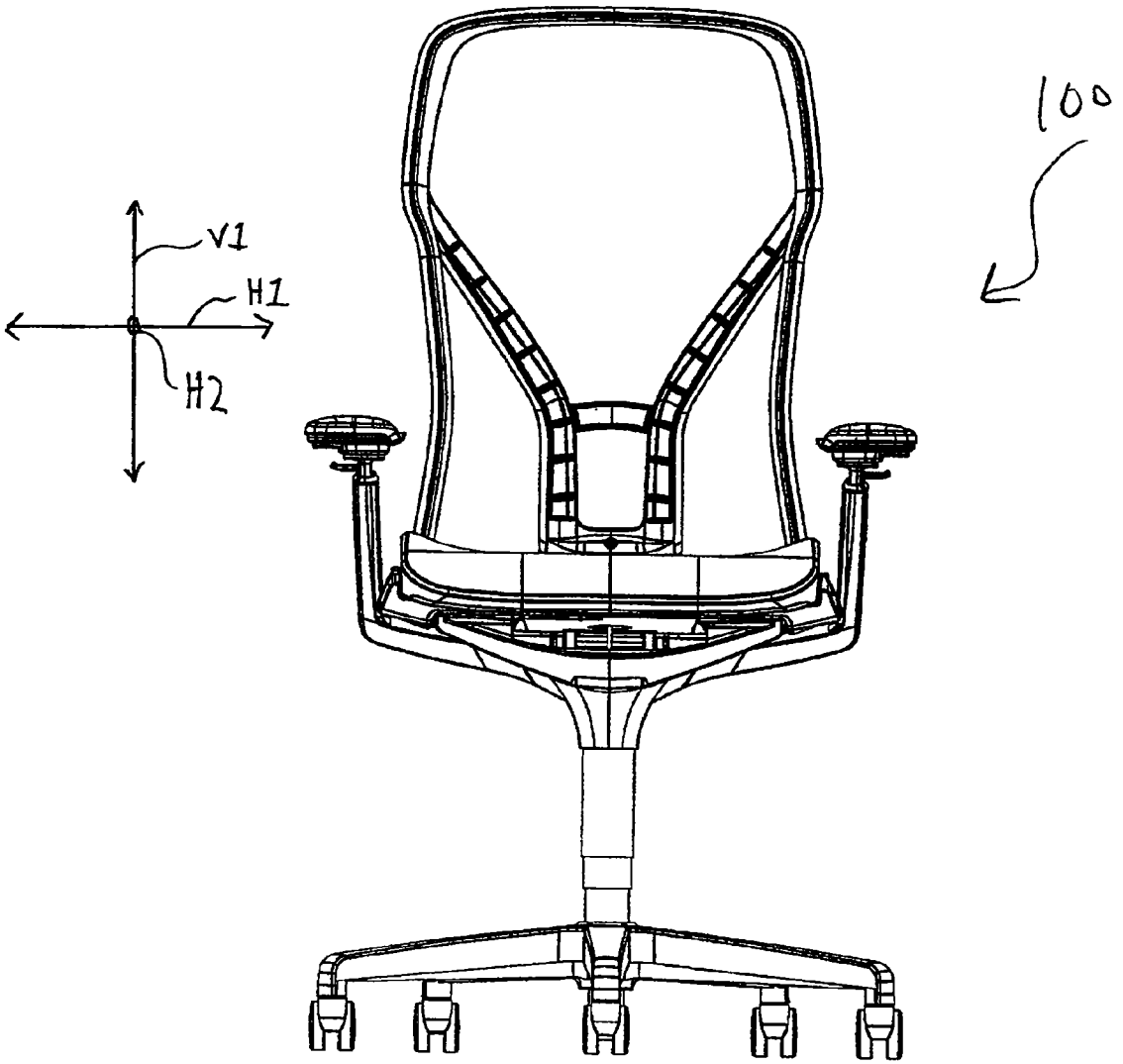
FIG. 2 illustrates front view of the chair of FIG. 1, according to embodiments of the present invention.
Figure 3:
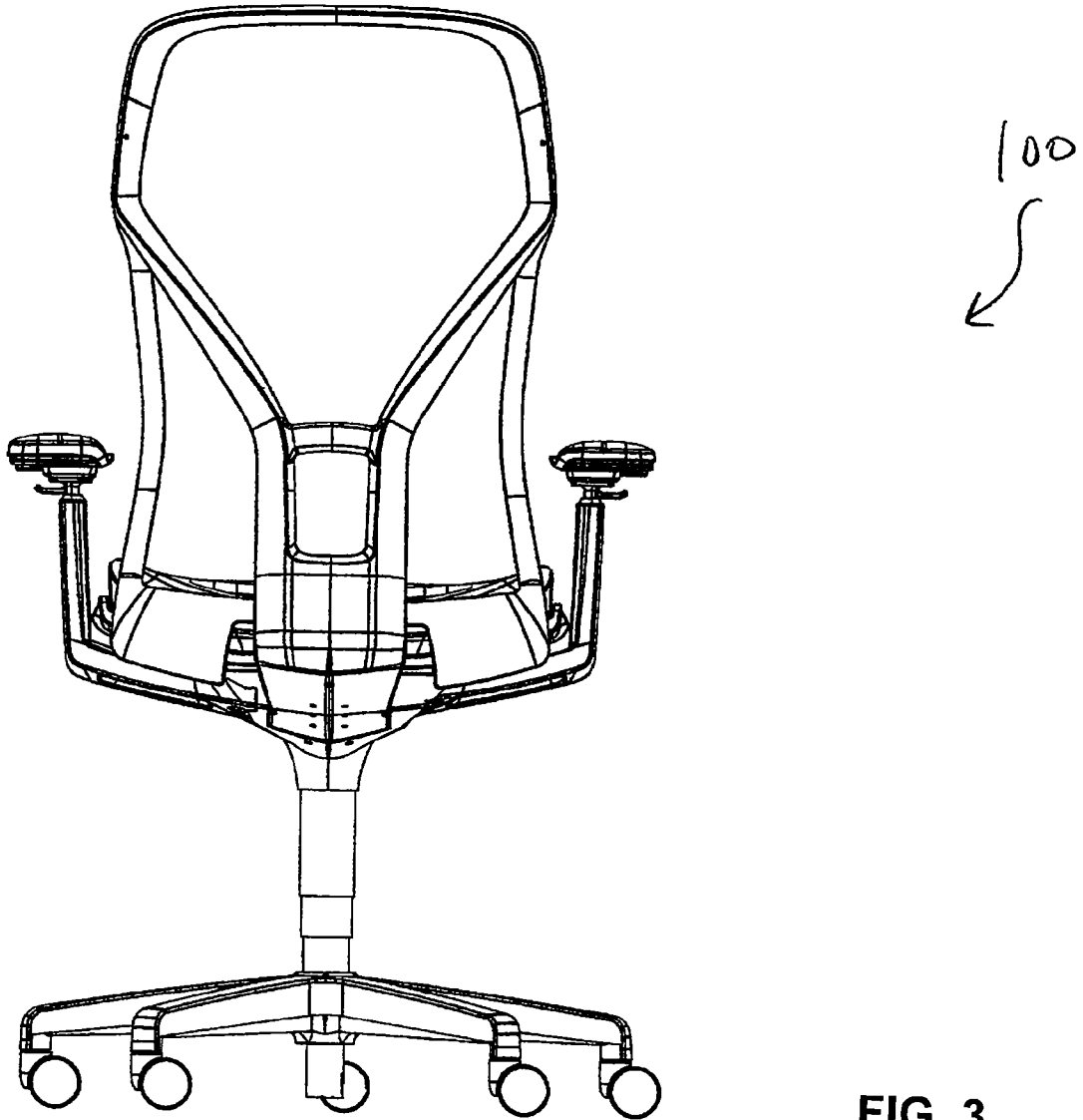
FIG. 3 illustrates back view of the chair of FIGS. 1 and 2, according to embodiments of the present invention.
Figure 4:
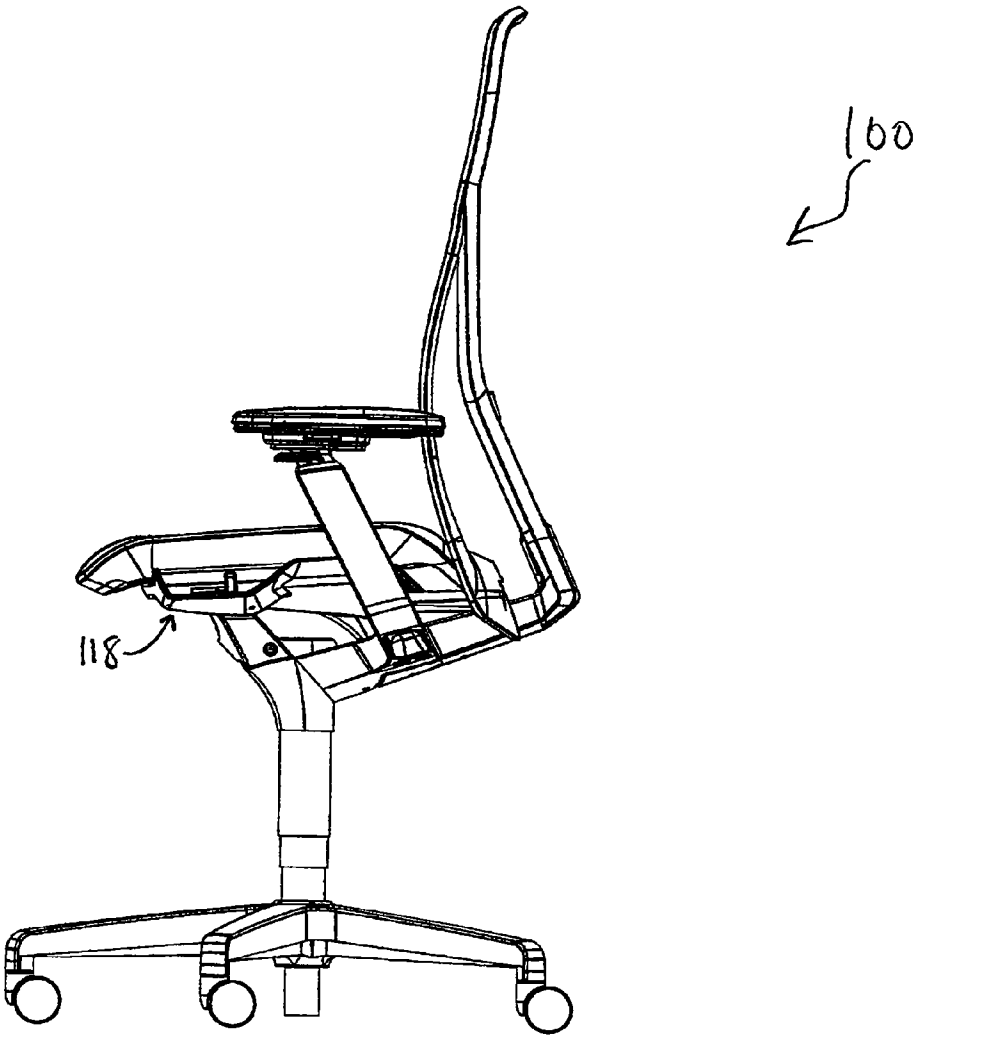
FIG. 4 illustrates a side view of the chair of FIGS. 1-3, according to embodiments of the present invention.
Figure 5:
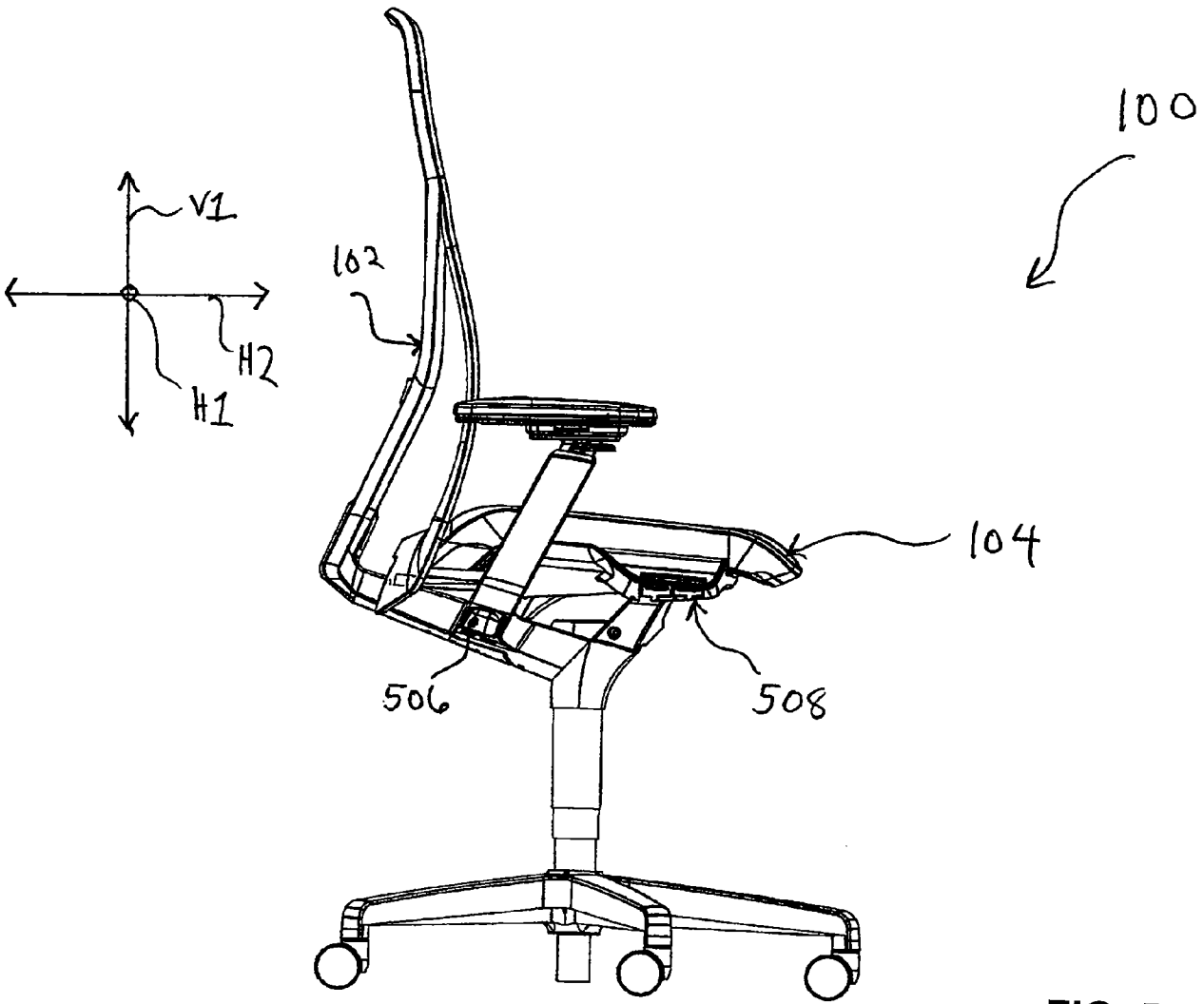
FIG. 5 illustrates another side view of the chair of FIGS. 1-4, according to embodiments of the present invention.
Figure 6:
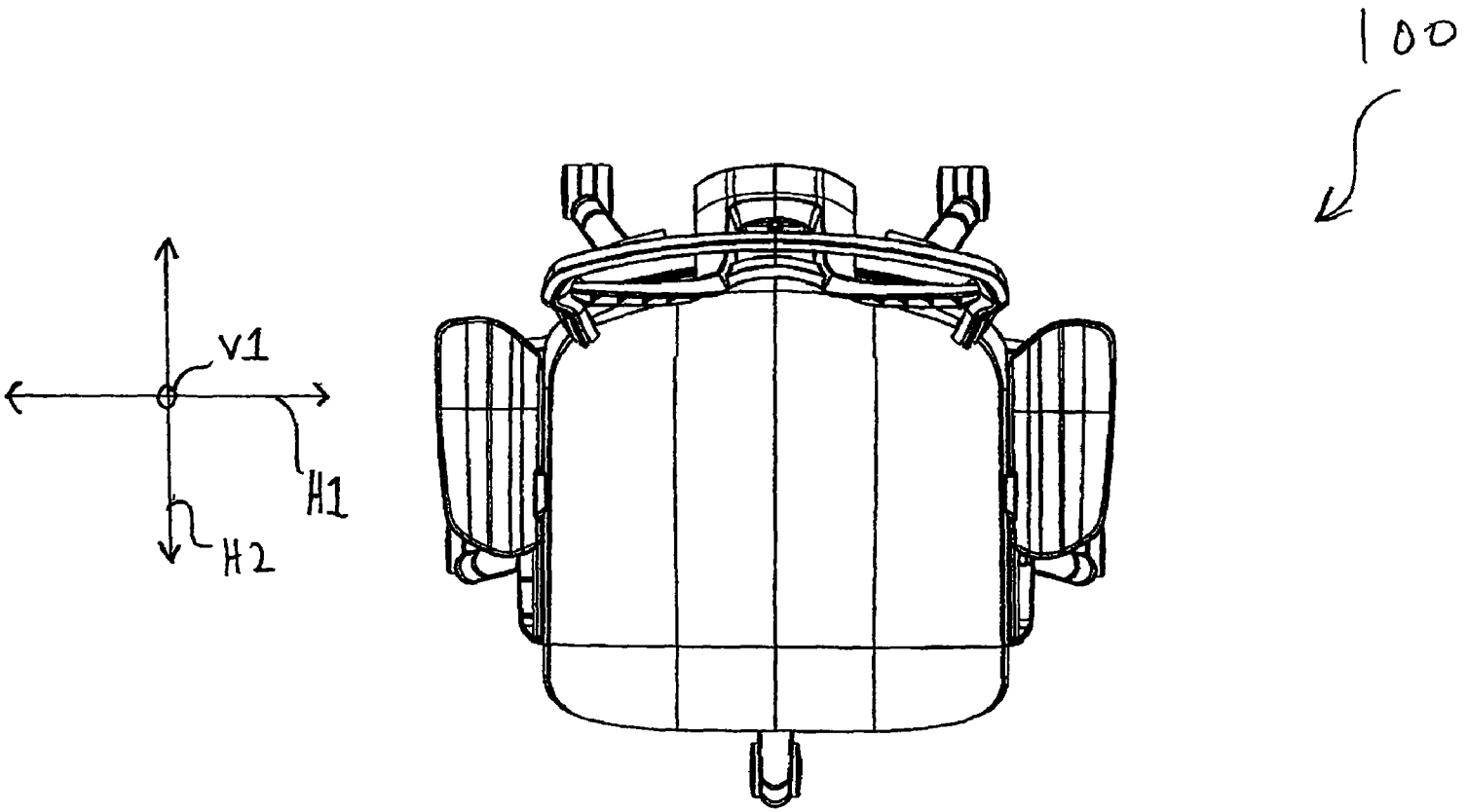
FIG. 6 illustrates a top view of the chair of FIGS. 1-5, according to embodiments of the present invention.
Figure 7:
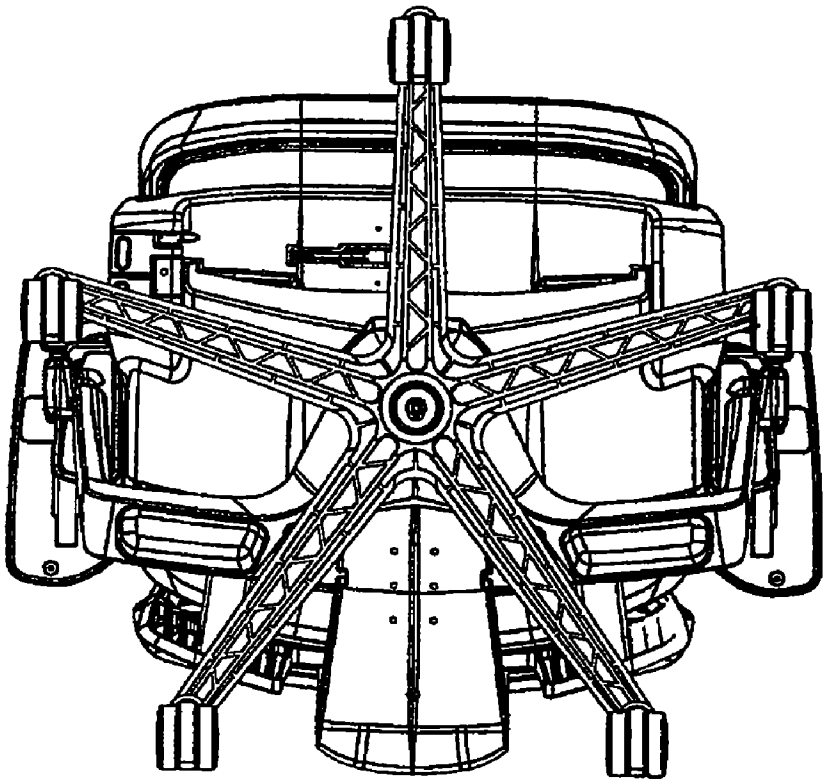
FIG. 7 illustrates a bottom view of the chair of FIGS. 1-6, according to embodiments of the present invention.

As used herein, the terms "horizontal," "horizontally," and the like are used in their broadest sense to refer to a direction along or parallel to a plane relative to a chair 100, where such plane is defined by the lines H1 and H2 depicted in FIGS. 2, 5 and 6. Although lines H1 and H2 are not shown in all views, the plane defined by H1 and H2 in FIGS. 2, 5 and 6 serves to define such plane in all views as such plane is defined relative to chair 100. As used herein, the terms "vertical," "vertically," and the like are used in their broadest sense to refer to a direction along or parallel to a line relative to a chair 100, where such line is defined by the line V1 of FIGS. 2, 5 and 6. Although line V1 is not shown in all views, line V1 serves to define such line in all views as such line is defined relative to chair 100.

Figure 8:
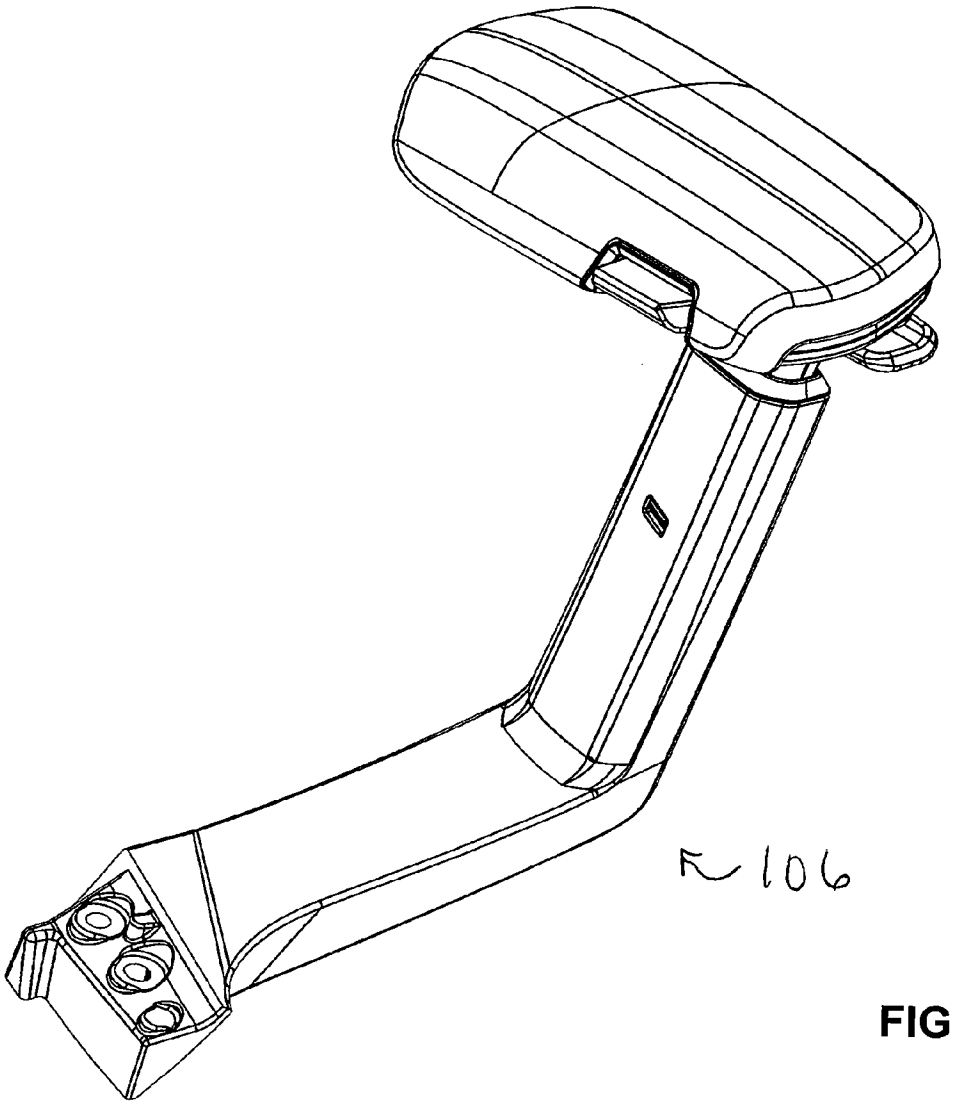
FIG. 8 illustrates a perspective view of a left chair arm according to embodiments of the present invention.
Figure 9:
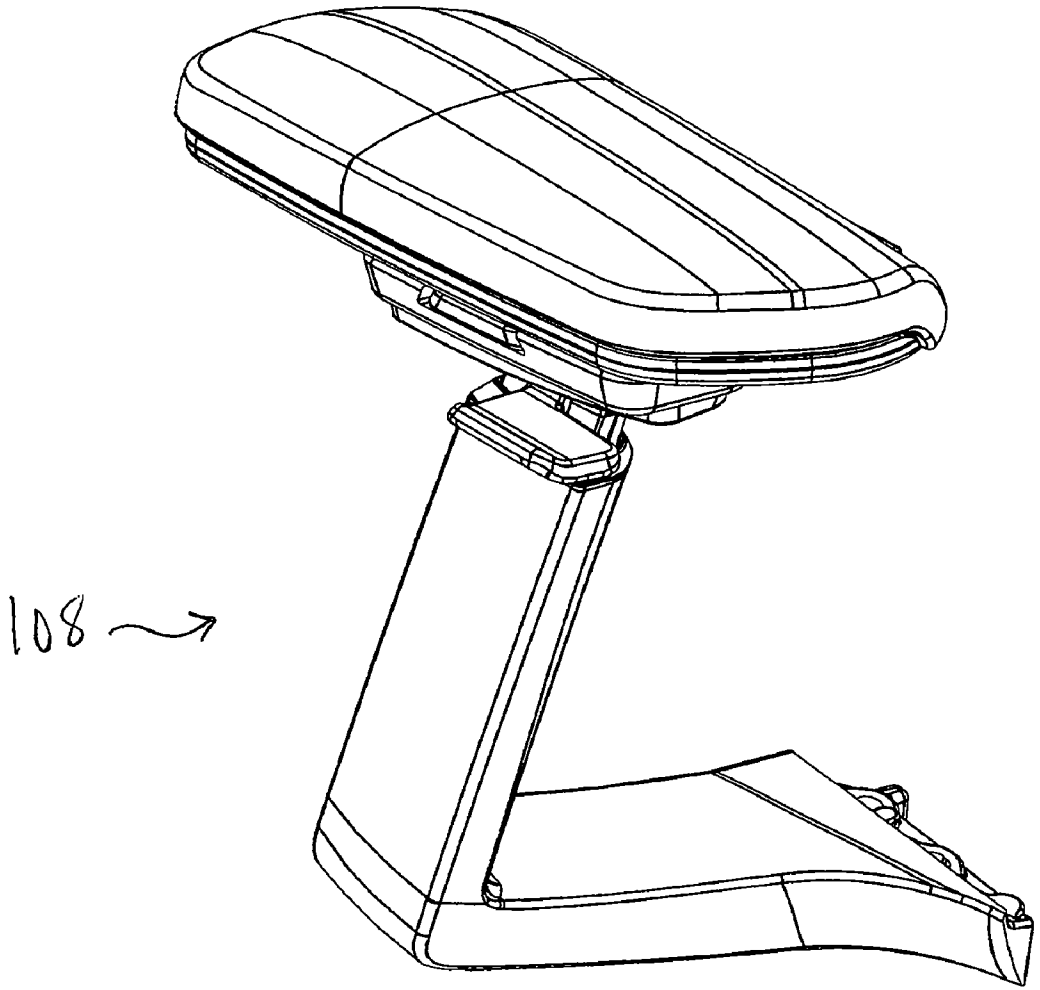
FIG. 9 illustrates a perspective view of a right chair arm according to embodiments of the present invention.
Figure 10:
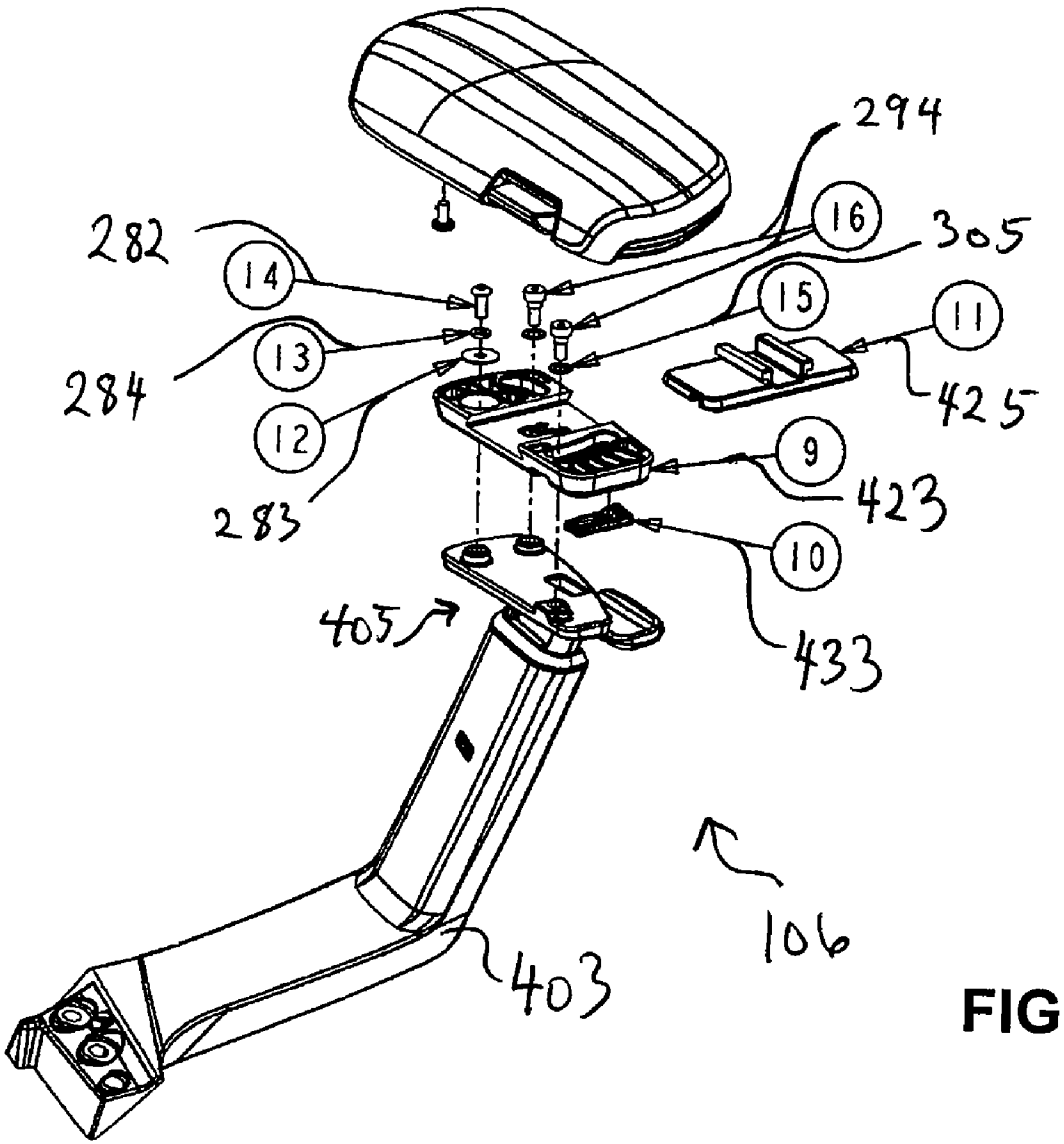
FIG. 10 illustrates an exploded perspective view of an arm assembly according to embodiments of the present invention.

FIG. 8 illustrates a perspective view of a left chair arm 106, and FIG. 9 illustrates a perspective view of a right chair arm 108 according to embodiments of the present invention. FIG. 10 illustrates an exploded perspective view of various swiveling components of arm 106 according to embodiments of the present invention. Arm 106 includes an arm pivot support 423 coupled to an arm base 405, for example via one or more screws 282, 294, washers 283, 305, and/or lock washers 284, according to embodiments of the present invention.

According to some embodiments of the present invention, the arm pivot support 423 is pivotably coupled to the arm base 405 at screw 282 and pivots about screw 282. Screw 16 contacts the segments of an arm pivot lock 433 to permit pivoting of the arm pivot support 423 with respect to the arm base 405 through several discrete pivot locations; for example, the arm pivot lock 433 may permit the arm pivot support 423 to pivot between three discrete pivot locations, according to embodiments of the present invention. An arm width slider 425 is slidably coupled to the arm pivot support 423, according to embodiments of the present invention, such that the arm pivot support 423 slides back and forth in a horizontal direction with respect to the arm pivot support 423.

Figure 11:
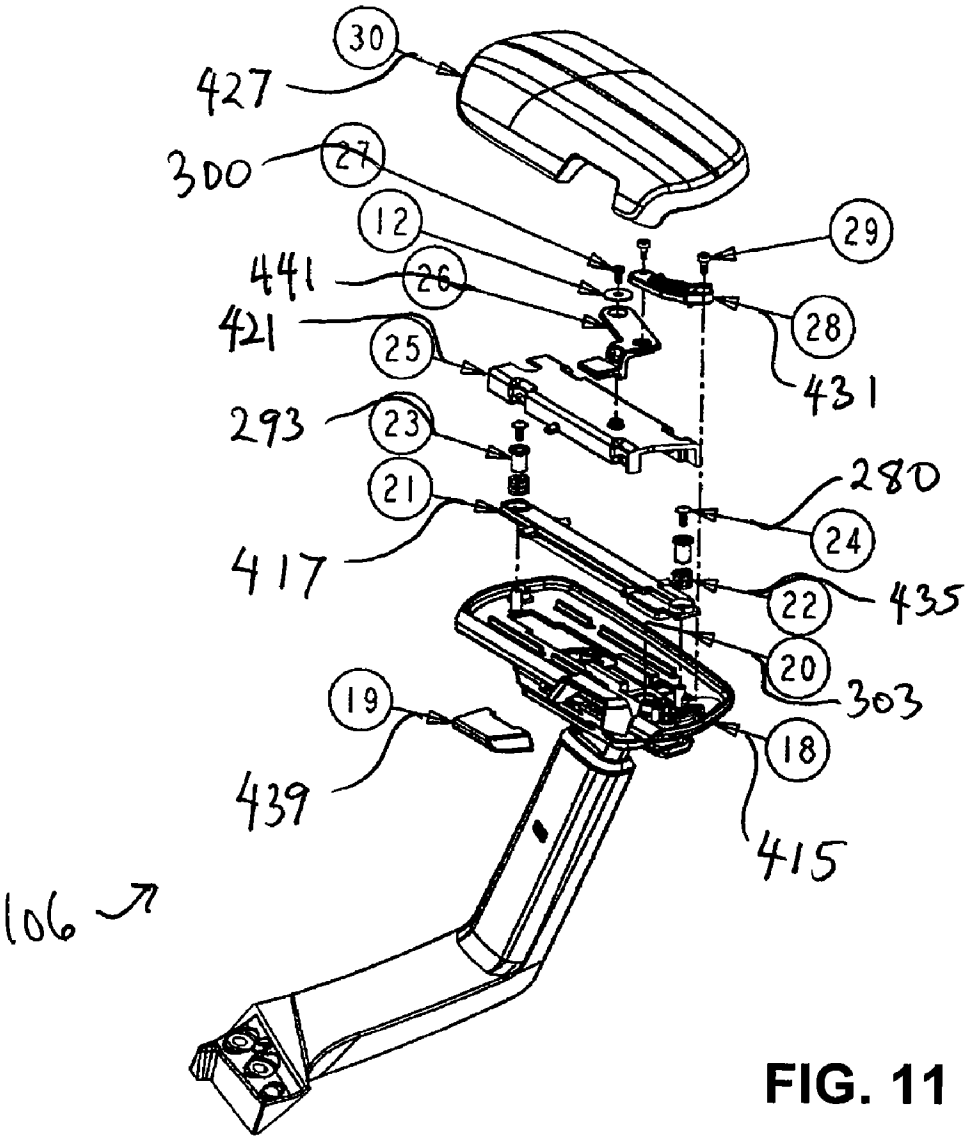
FIG. 11 illustrates another exploded perspective view of the arm assembly of FIG. 10, according to embodiments of the present invention.
Figure 14:
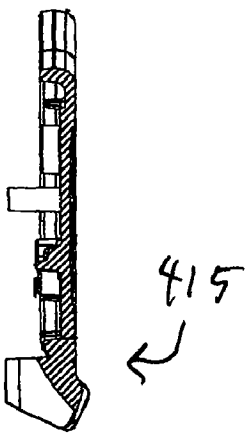
FIG. 14 illustrates a side cross sectional view of the arm depth slider of FIG. 12, taken along line B-B of FIG. 12, according to embodiments of the present invention.

FIG. 11 illustrates another exploded perspective view of the chair arm 106, according to embodiments of the present invention. An arm depth slider 415 is slidably coupled to the arm width slider 425, according to embodiments of the present invention. The arm depth slider 415 slides back and forth along a substantially horizontal direction with respect to the arm width slider 425, according to embodiments of the present invention. According to some embodiments of the present invention, the arm width slider 425 slides back and forth in a direction with respect to the arm pivot support 423 which intersects another direction in which the arm depth slider 415 slides back and forth with respect to the arm width slider 425. According to some embodiments of the present invention, the arm depth slider 415 and the arm width slider 425 slide back and forth in substantially horizontal directions. According to other embodiments of the present invention, the arm depth slider 415 and the arm width slider 425 slide back and forth in substantially horizontal perpendicular directions.

An arm brake assembly 417 may be coupled to the arm depth slider 415 with screws 280 and bushings 293, according to embodiments of the present invention. Arm clamp springs 435 push against the bushings 293 and the arm brake assembly 417 to push the arm brake assembly 417 downward through the arm depth slider 415, according to embodiments of the present invention. Springs 435 push the arm brake assembly 417 against the arm pivot support 423 to substantially prevent the substantially horizontal sliding of the arm width slider 425 and/or the arm depth slider 415 when the arm brake assembly 417 is engaged with the arm pivot support 423, such as, for example, when the arm brake assembly 417 is in frictional engagement with the arm pivot support 423, according to embodiments of the present invention. The arm clamp springs 435 may have a spring rate of 103 pounds per inch, with 2.266 active coils and 4.266 total coils, according to embodiments of the present invention.

According to some embodiments of the present invention, not only does the arm depth slider 415 move in a substantially horizontal plane simultaneously along two transverse directions with respect to the arm pivot support 423, but also the frictional-type engagement of the arm brake assembly 417 with the underlying arm pivot support 423 permits the arm depth slider 415 to be locked into any number of infinite positions within its range of motion with respect to the arm pivot support 423. Because the position of the arm depth slider 415 need not be confined to a defined set of coordinates when the arm brake assembly 417 is engaged with the arm pivot support 423, the user is given a greater degree of customization. In other words, the arm depth slider 415 moves in a substantially horizontal plane in two degrees of freedom when the brake assembly 417 is in an unlocked position, such that the arm depth slider 415 can move to an infinite number of positions within its range of motion, and also the arm depth slider 415 can be locked with respect to the arm pivot support 423 in an infinite number of positions by moving the arm brake assembly 417 back into engagement (e.g. frictional engagement) with the arm pivot support 423, according to embodiments of the present invention.

The arm brake assembly 417 may be raised and lowered by a brake lifter 421 in engagement with the arm depth slider 415, according to embodiments of the present invention. Pegs on the arm brake assembly 417 may extend through ramp openings on the brake lifter 421 such that sliding the brake lifter 421 causes the pegs and thus the arm brake assembly 417 to move vertically as the pegs travel along ramps formed in the ramp openings, according to embodiments of the present invention. The brake lifter 421 may be slidably coupled to the arm depth slider 415, according to embodiments of the present invention. For example, an arm link 431 may be pivotably coupled to the arm depth slider 415 and to an arm button link 441, and the arm button link 441 may also be pivotably coupled to the brake lifter 421, such that pushing a button 439 coupled to the arm button link 441 changes an angle formed between the arm link 431 and the arm button link 441 to slide the brake lifter 421 with respect to the arm depth slider 415, according to embodiments of the present invention. For example, pushing the button 439 may be configured to increase an angle formed between the arm link 431 and the arm button link 441, such that as the arm link 431 and button link 441 angle approaches a one hundred eighty degree angle, the work required to hold the button 439 in position to raise the brake assembly 417 decreases, according to embodiments of the present invention. According to some embodiments of the present invention, the range of motion of the arm link 431 and/or the arm button link 441 is limited such that the angle between the arm link 431 and the arm button link 441 remains less than one hundred eighty degrees, such as, for example, to avoid an over-centering situation in which the button becomes stuck in a depressed position.

The arm pad assembly 427 may be coupled to the arm depth slider 415 such that the arm pad assembly 427 moves with and according to the arm depth slider 415, according to embodiments of the present invention. For this reason, the terms "arm depth slider" and "arm pad base" are used interchangeably herein. As such, the term "arm pad base" may also include an arm pad base that is coupled directly or indirectly to the arm pivot support 423 in ways which differ from the depicted coupling between the arm depth slider 415 and the arm pivot support 423, according to embodiments of the present invention.

Figure 29:
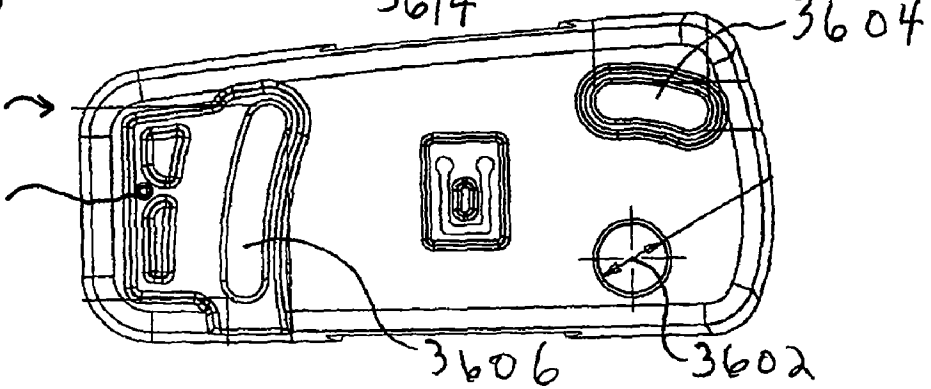
FIG. 29 illustrates a bottom plan view of the arm pivot support of FIGS. 27-28, according to embodiments of the present invention.
Figure 31:
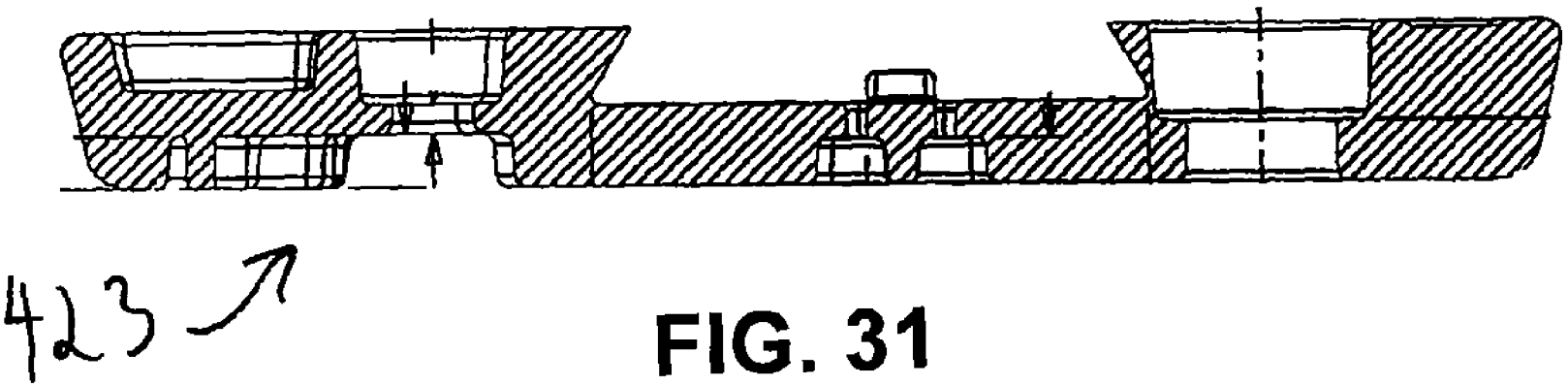
FIG. 31 illustrates a side cross sectional view of the arm pivot of FIG. 27 taken along line A-A of FIG. 27, according to embodiments of the present invention.
Figure 33:
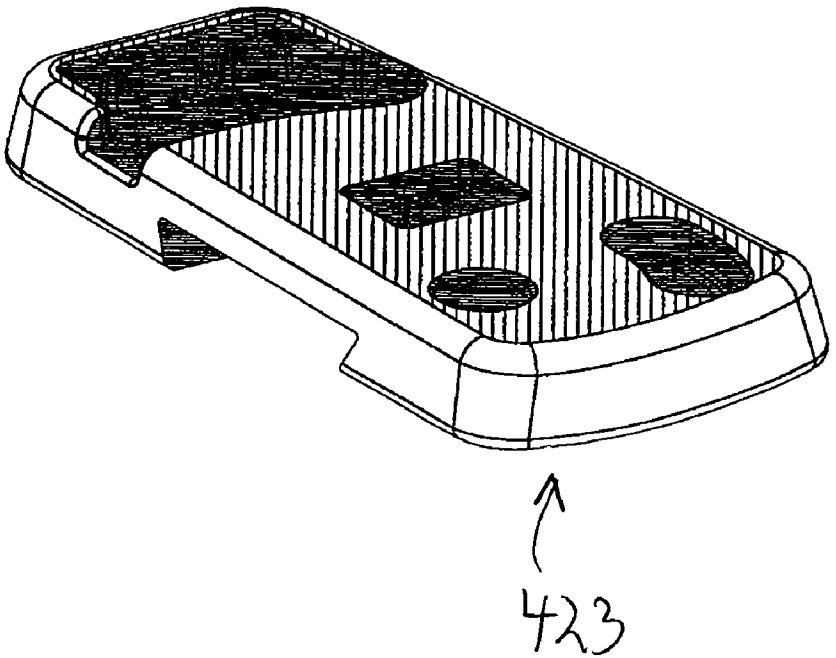
FIG. 33 illustrates a bottom perspective view of the arm pivot support of FIGS. 27-32, according to embodiments of the present invention.
Figure 32:
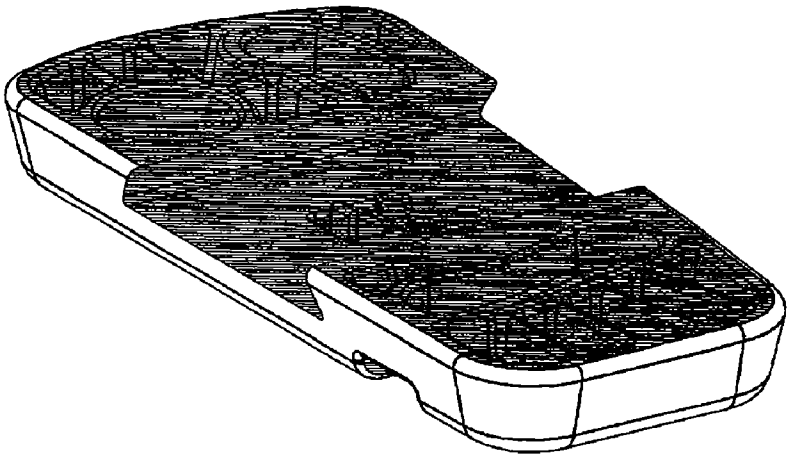
FIG. 32 illustrates a top perspective view of the arm pivot support of FIGS. 27-31, according to embodiments of the present invention.
Figure 36:
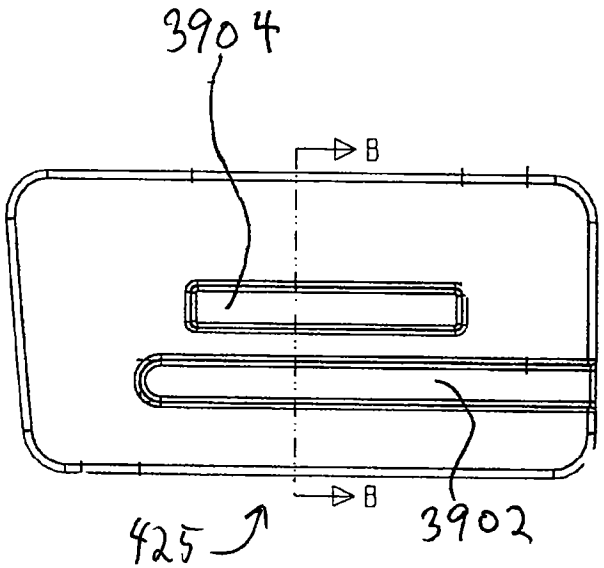
FIG. 36 illustrates a bottom plan view of the arm width slider of FIGS. 34-35, according to embodiments of the present invention.
Figure 37:
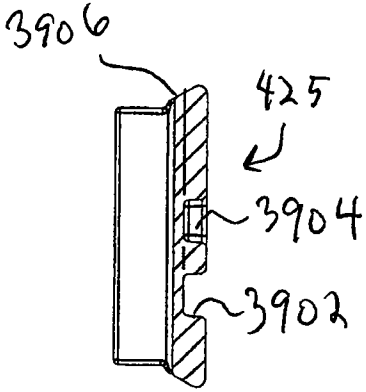
FIG. 37 illustrates a side cross-sectional view of the arm width slider of FIGS. 34-36, according to embodiments of the present invention.
Figure 34:
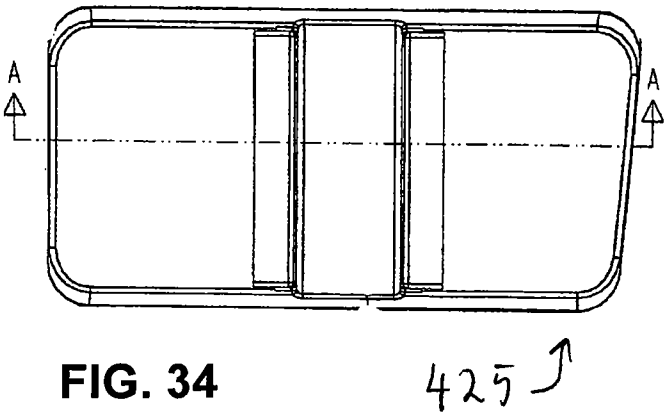
FIG. 34 illustrates a top plan view of an arm width slider, according to embodiments of the present invention.
Figure 35:
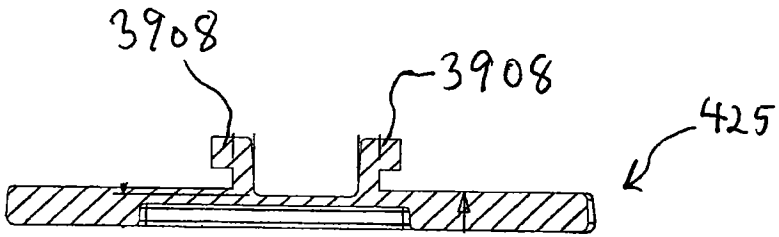
FIG. 35 illustrates a front cross-sectional view of the arm width slider of FIG. 34, taken along line A-A of FIG. 35, according to embodiments of the present invention.
Figure 39:
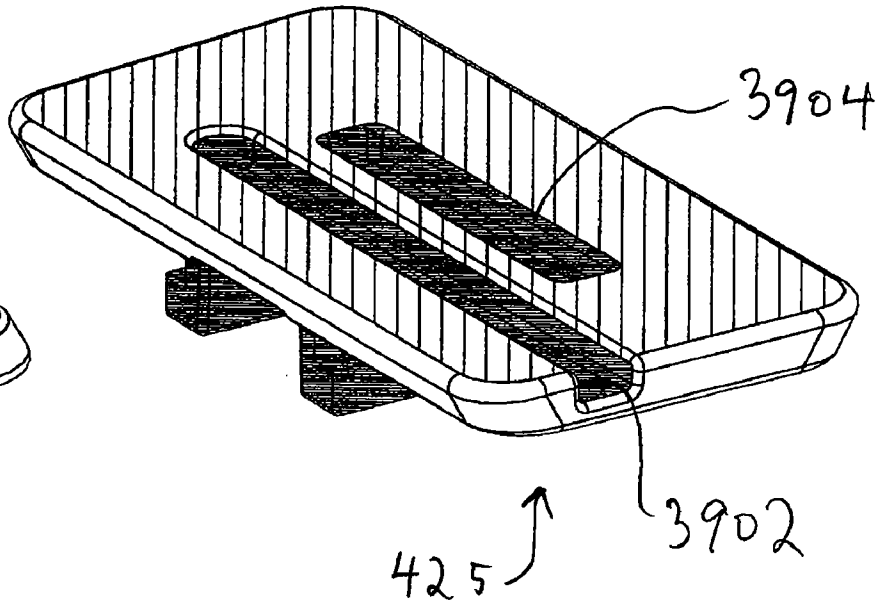
FIG. 39 illustrates a bottom perspective view of the arm width slider of FIGS. 34-38, according to embodiments of the present invention.
Figure 38:
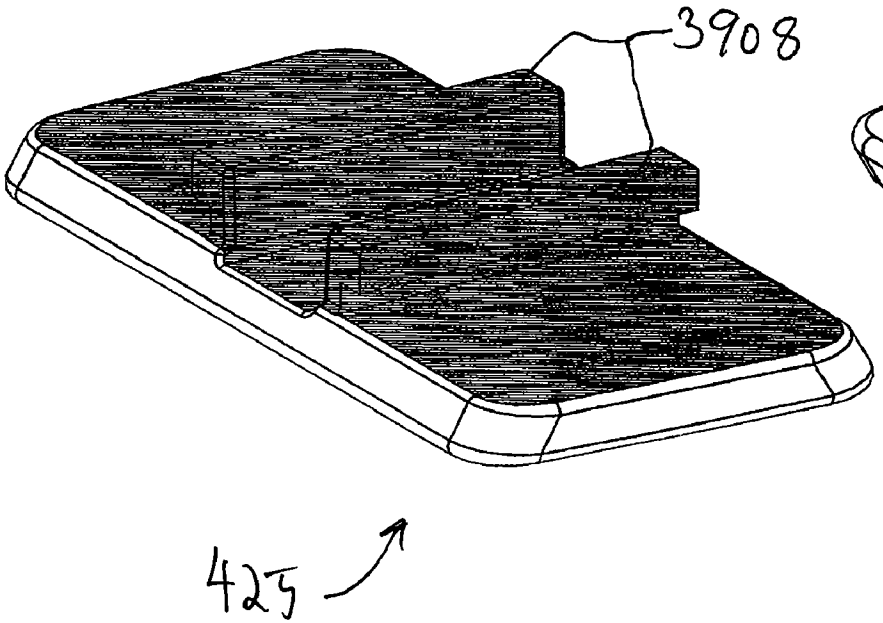
FIG. 38 illustrates a top perspective view of the arm width slider of FIGS. 34-37, according to embodiments of the present invention.
Figure 41:
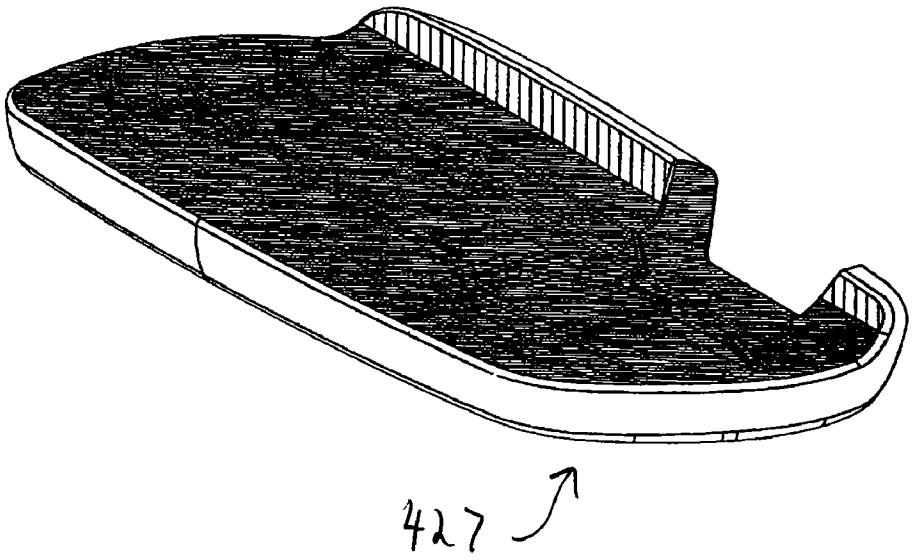
FIG. 41 illustrates a bottom perspective view of the arm pad assembly, according to embodiments of the present invention.
Figure 40:
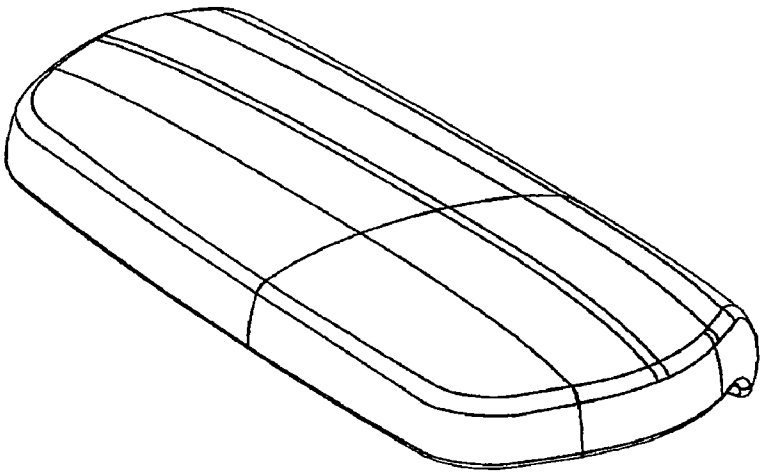
FIG. 40 illustrates a top perspective view of an arm pad assembly, according to embodiments of the present invention.
Figure 45:
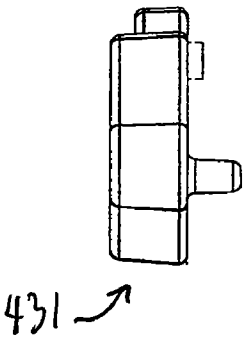
FIG. 45 illustrates a side elevation view of the arm link of FIGS. 42-44, according to embodiments of the present invention.
Figure 47:
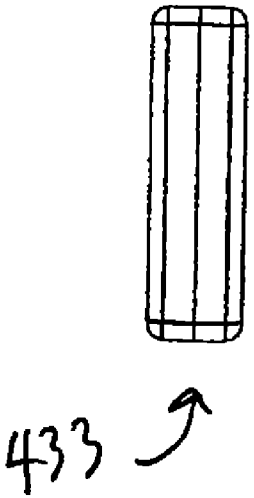
FIG. 47 illustrates a side elevation view of the arm pivot lock of FIG. 46, according to embodiments of the present invention.
Figure 46:
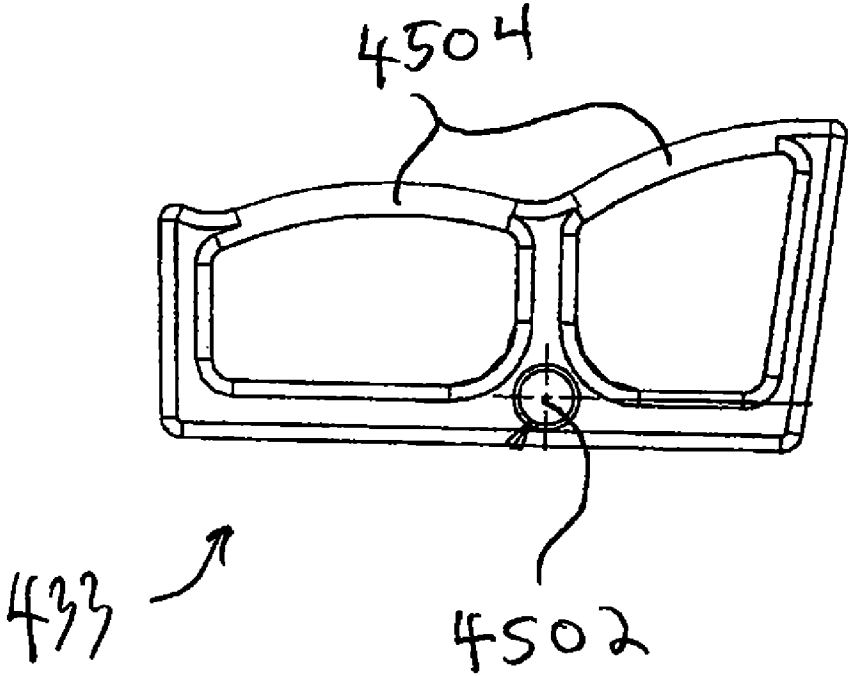
FIG. 46 illustrates a front plan view of an arm pivot lock, according to embodiments of the present invention.

The arm pivot support 423 may be attached to the arm support assembly 405 as illustrated. Arm pivot support 423 includes a hole 3602 and two curved slots 3604, 3606, as well as a tab 3608 and a guide protrusion 3610 (see FIGS. 27-33), according to embodiments of the present invention. A screw 282 may be placed through a lock washer 284, through another washer 283, through hole 3602 and into arm support assembly 405 as illustrated, to swivelably couple arm pivot support 423 with arm support assembly 405, according to embodiments of the present invention. A screw 294 may be placed through a washer 305, through slot 3604, and into arm support assembly 405 as illustrated. Another screw may be 294 may be placed through a washer 305, through slot 3606, and into arm support assembly 405 as illustrated. An arm pivot lock 433 may be attached under arm pivot support 423 by placing a connector through hole 4502 (see FIGS. 46-47) and then through hole 3612 (see FIG. 29), according to embodiments of the present invention.

The resulting configuration permits arm pivot support to swivel in a substantially horizontal plane about pivot point 3602, with the range of swiveling motion limited by the extent of slot 3604 and/or 3606. According to some embodiments of the present invention, the range of swiveling motion is limited by slot 3604 to approximately twenty-five degrees due to the placement of screw 294 through and within slot 3604. In one embodiment, arm pivot lock 433 may be configured to provide swiveling resistance and/or a set of pre-defined positions between which arm pivot support 423 may be swiveled, by contacting the screw 294 which has been placed through slot 3606 with the outer edge 4504 of arm pivot lock 433. According to some embodiments of the present invention, use of arm pivot lock 433 imparts a "center" position, a "left" position, and a "right" position.

The arm width slider 425 slidably couples arm pivot support 423 with arm depth slider 415, according to embodiments of the present invention. Arm width slider 425 (see FIGS. 34-39) includes a slot 3902 which extends to the edge of arm width slider 425 and another slot 3904 which does not extend to the edge of arm width slider 425. Arm pivot support 423 (see FIGS. 27-33) includes an edge 3614 shaped to correspond with an outer edge 3906 of arm width slider 425; arm width slider 425 may be inserted or slid into arm pivot support 423 by inserting slot 3902 over guide protrusion 3610; tab 3608 may be depressed initially as arm width slider 425 is slid into arm pivot and then may pop up once slot 3904 passes over tab 3608. Once tab 3608 has popped up within slot 3904, the lateral sliding movement of arm width slider 425 is limited by tab 3608 and slot 3904, and is further stabilized by guide protrusion 3610 within slot 3902, according to embodiments of the present invention. Thus, arm width slider 425 is able to freely slide back and forth in a substantially horizontal direction with respect to arm pivot support 423.

Arm width slider 425 includes a pair of prongs 3908 which may be inserted through a widest portion 2802 of a slot formed within arm depth slider 415, after which the prongs 3908 may be slid over rails 2804 such that arm depth slider 415 slides on arm width slider 425 in a forward and backward substantially horizontal direction along prongs 3908. Arm brake assembly 417 may be coupled with arm depth slider 415 by inserting hole 3108 over mount 2810 and by inserting hole 3106 over mount 2822, then by inserting an arm clamp spring 435, bushing 293, and screw 280 onto each mount 2810, 2822. Arm brake assembly 417 is sized to fit within the slot formed in arm depth slider 415, such that shoulders 3102 are placed near edges 2806 and shoulders 3104 are placed near edges 2808, according to embodiments of the present invention. Once arm brake assembly 417 is in place, the forward and backward movement of arm depth slider 415 along arm width slider 425 is limited by the abutment of the arm width slider 425 against posts 3110 in a forward position and by the abutment of the arm width slider 425 against shoulder 3104 in a rearward position, according to embodiments of the present invention. As used herein, the phrase "range of motion" is used in its broadest sense to refer to the full set of positions available for one element with respect to another. For example, the range of motion of the width slider 425 includes the furthest the width slider 425 can move in one direction with respect to the arm pivot support 423 and the furthest the width slider 425 can move in the opposite direction with respect to the arm pivot support 423, and all positions in between. The range of motion of the arm depth slider 415 includes all positions between the furthest forward, backward, and sideways extents to which the arm depth slider 415 can slide with respect to the arm pivot support 423, according to embodiments of the present invention.

Figure 17:
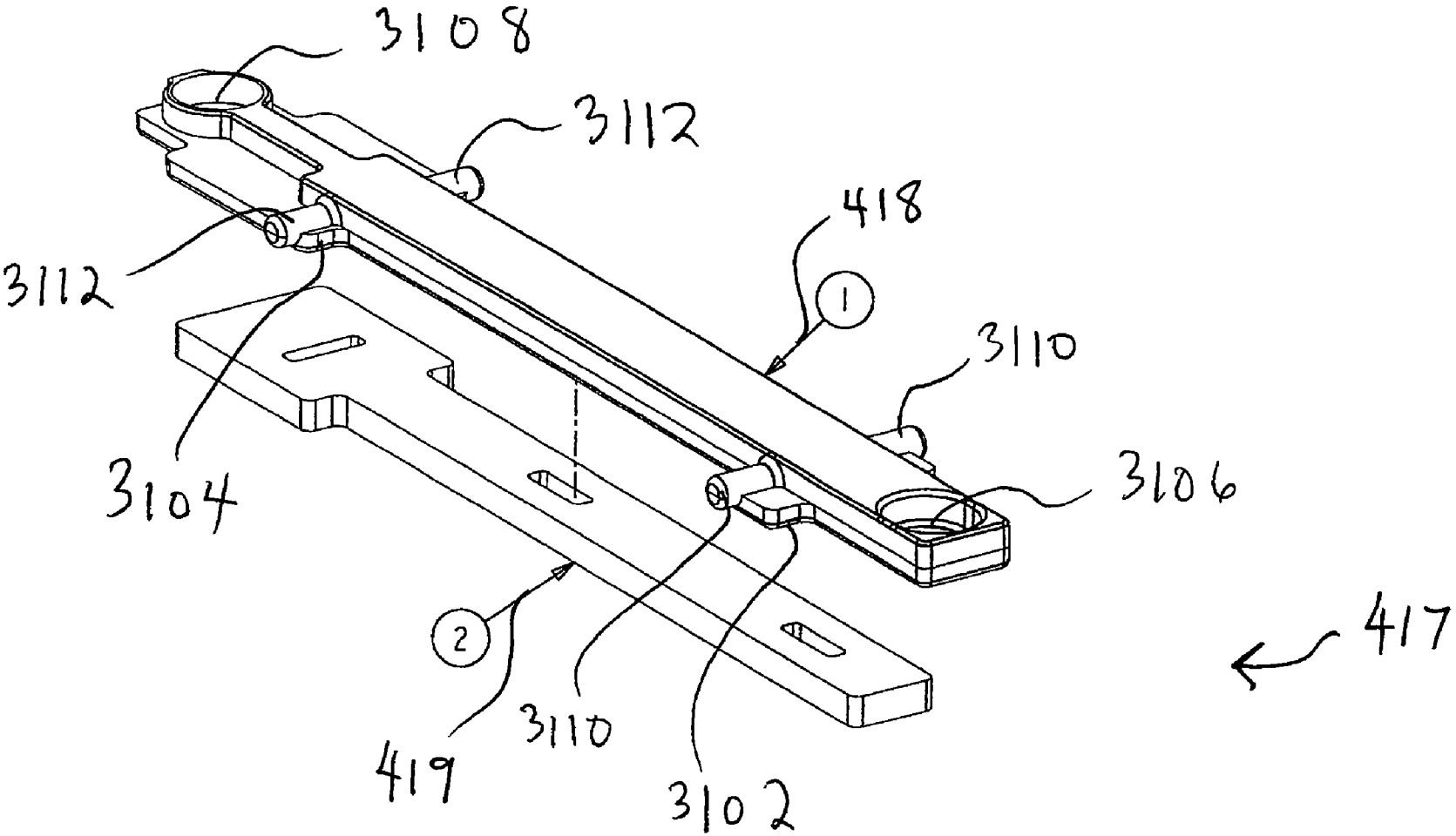
FIG. 17 illustrates an exploded perspective view of an arm brake assembly, according to embodiments of the present invention.
Figure 18:
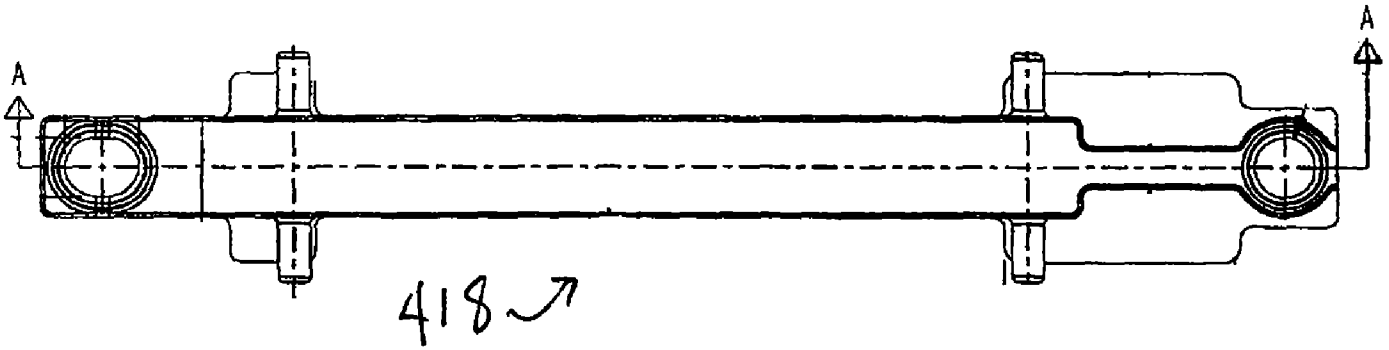
FIG. 18 illustrates a top plan view of an arm brake, according to embodiments of the present invention.
Figure 19:
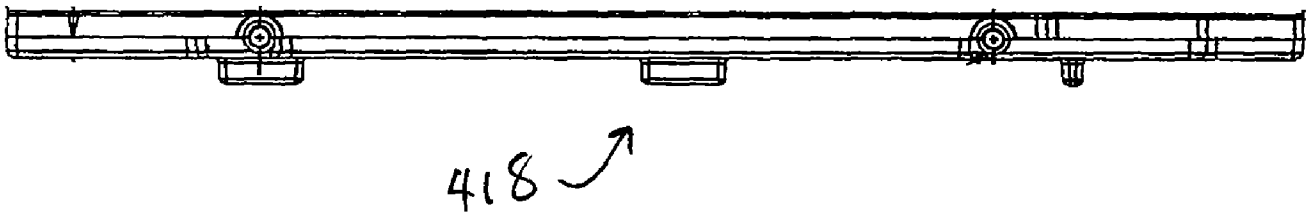
FIG. 19 illustrates a side elevation view of the arm brake of FIG. 18, according to embodiments of the present invention.
Figure 20:
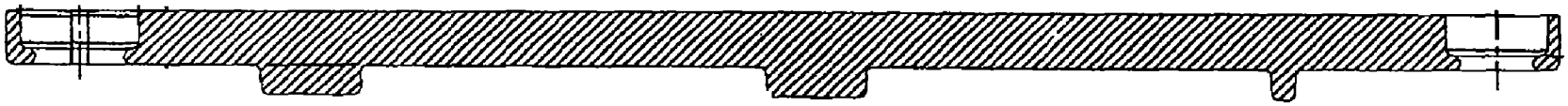
FIG. 20 illustrates a cross-sectional view of the arm brake of FIG. 18, taken along line A-A of FIG. 18, according to embodiments of the present invention.
Figure 21:
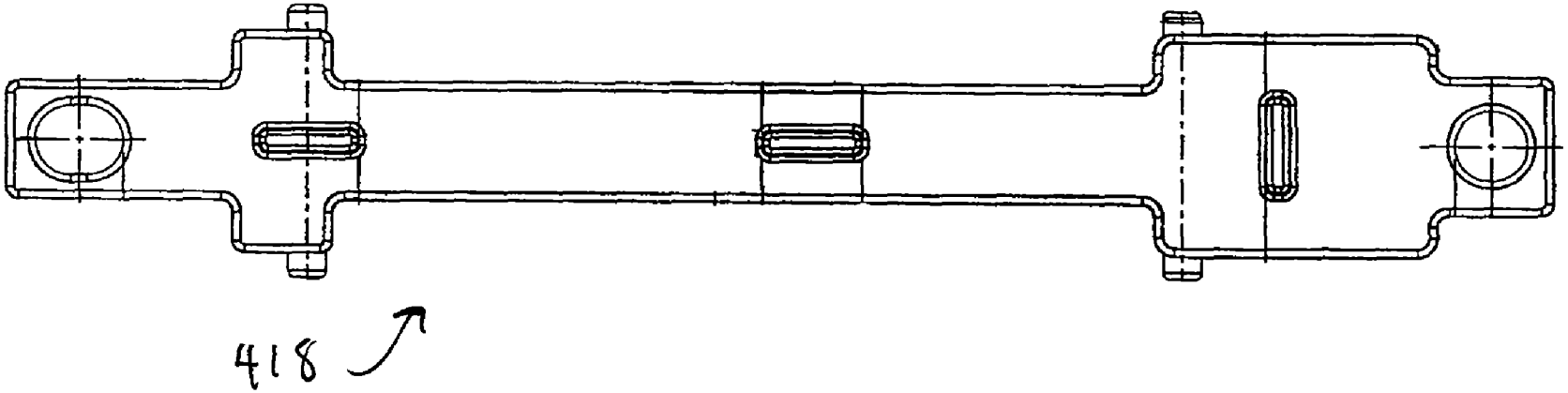
FIG. 21 illustrates a bottom plan view of the arm brake of FIGS. 18-19, according to embodiments of the present invention.
Figure 22:
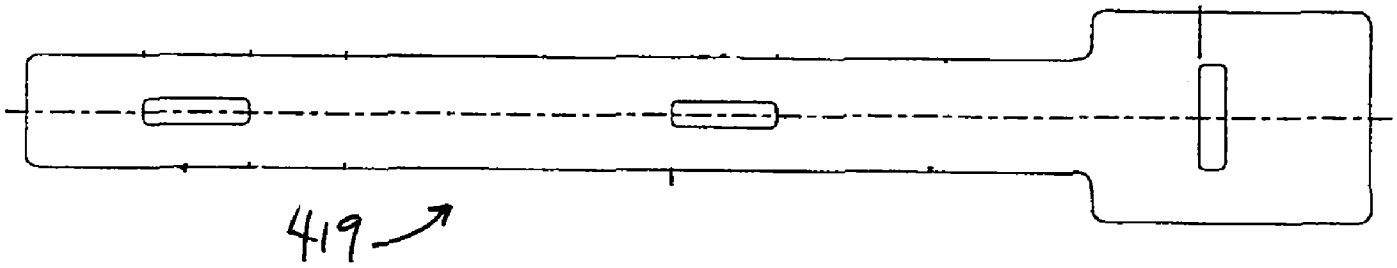
FIG. 22 illustrates a top plan view of an arm brake pad, according to embodiments of the present invention.
Figure 23:
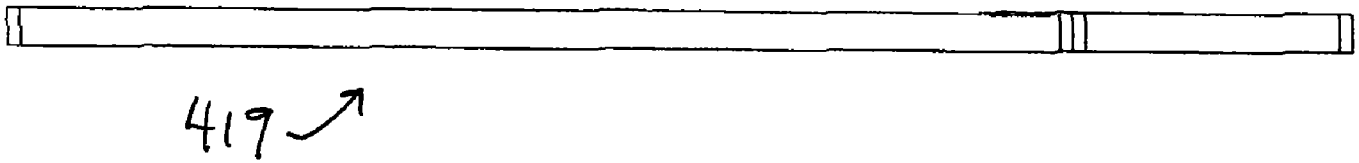
FIG. 23 illustrates a side elevation view of the arm brake pad of FIG. 22, according to embodiments of the present invention.
Figure 26:
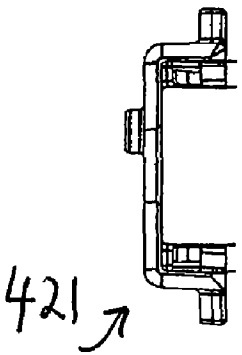
FIG. 26 illustrates a front elevation view of the brake lifter of FIGS. 24-25, according to embodiments of the present invention.
Figure 48:
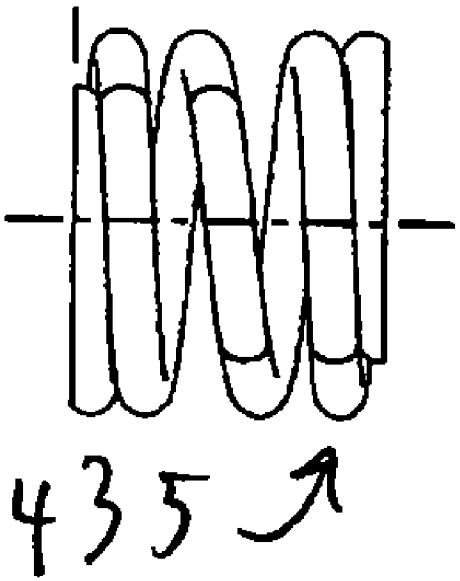
FIG. 48 illustrates a side elevation view of an arm clamp spring, according to embodiments of the present invention.
Figure 49:
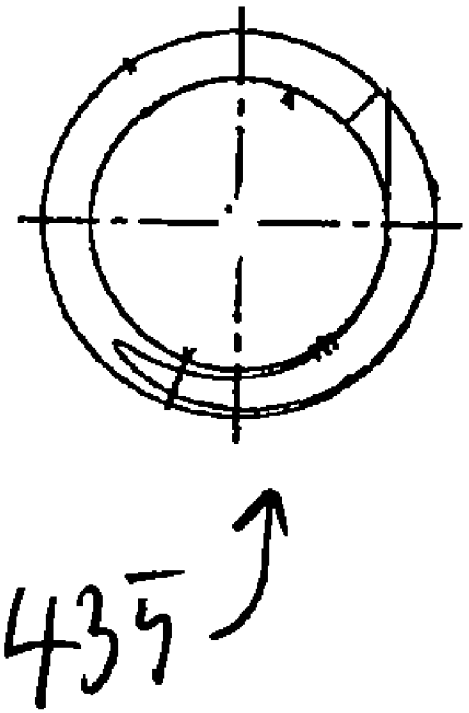
FIG. 49 illustrates a front elevation view of the arm clamp spring of FIG. 48, according to embodiments of the present invention.
Figure 50:
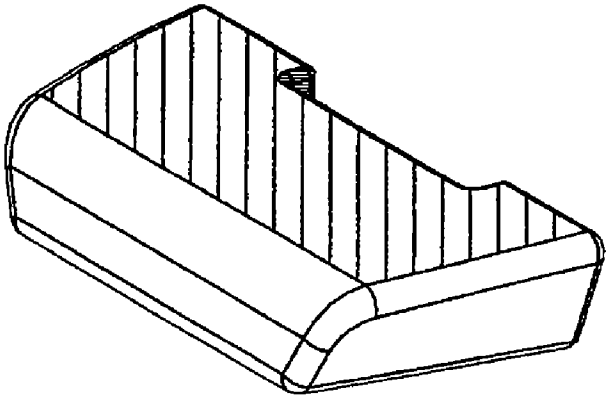
FIG. 50 illustrates a bottom perspective view of a button, according to embodiments of the present invention.
Figure 51:
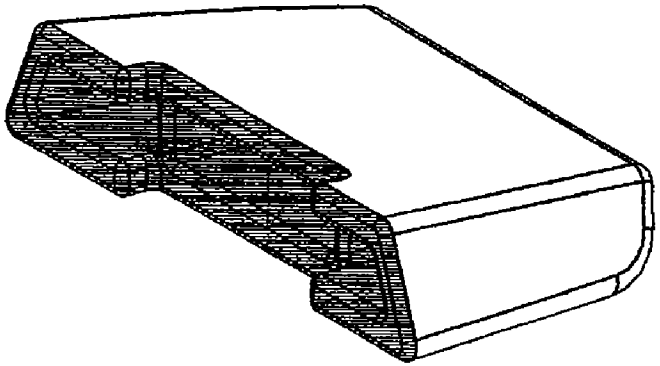
FIG. 51 illustrates a top perspective view of the button of FIG. 50, according to embodiments of the present invention.

Arm brake assembly 417 includes an arm brake 418 and an arm brake pad 419 attached underneath the arm brake 418 (see FIG. 17). Arm brake assembly 417 is biased in the downward or "locked" position by the arm clamp springs 435 (see FIGS. 48-49), according to embodiments of the present invention. In the down or locked position, arm brake pad 419 is pushed against a top surface of arm pivot support 423, thereby substantially inhibiting horizontal forward or backward or side-to-side translation of arm pad assembly 427 with respect to arm pivot support 423.

Figure 12:
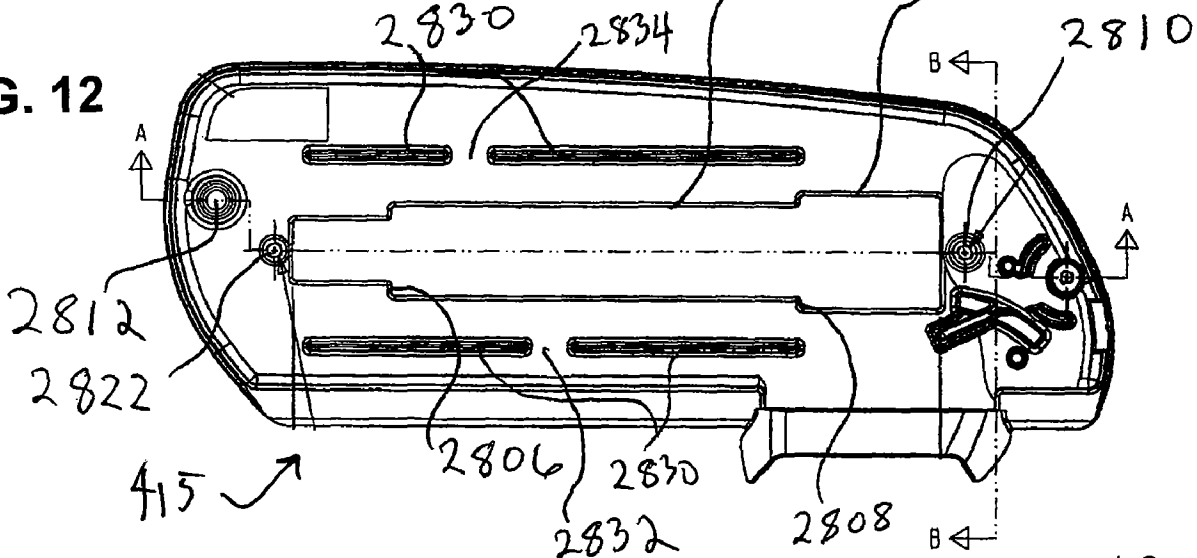
FIG. 12 illustrates a top view of an arm depth slider, according to embodiments of the present invention.
Figure 13:
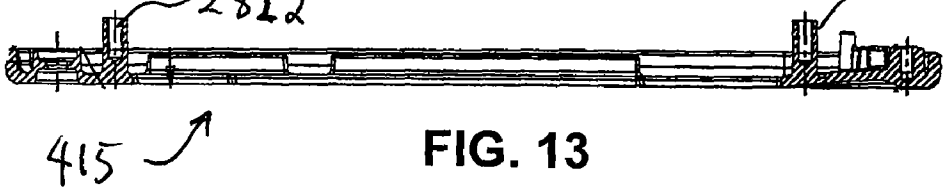
FIG. 13 illustrates a side cross sectional view of the arm depth slider of FIG. 12, taken along line A-A of FIG. 12, according to embodiments of the present invention.
Figure 16:
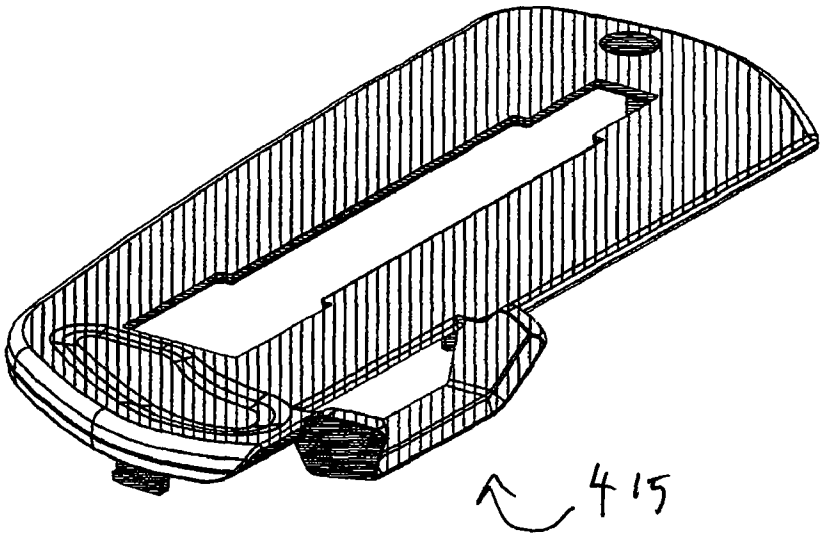
FIG. 16 illustrates a bottom perspective view of the arm depth slider of FIGS. 12-15, according to embodiments of the present invention.
Figure 15:
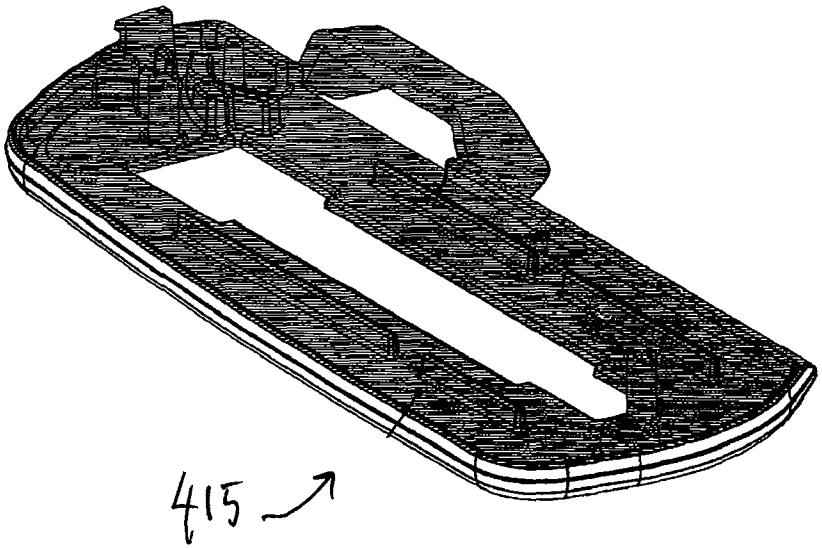
FIG. 15 illustrates a top perspective view of the arm depth slider of FIGS. 12-14, according to embodiments of the present invention.
Figure 24:
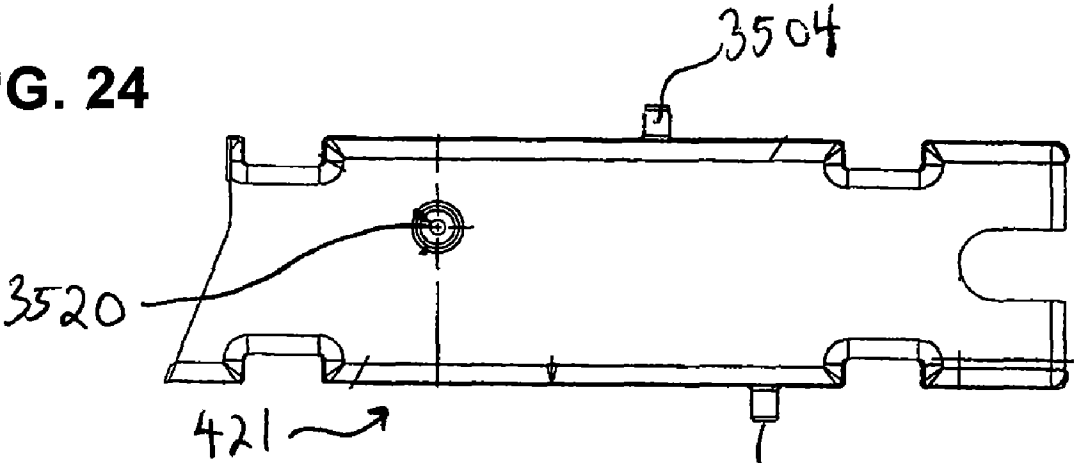
FIG. 24 illustrates a partial top plan view of a brake lifter, according to embodiments of the present invention.
Figure 25:
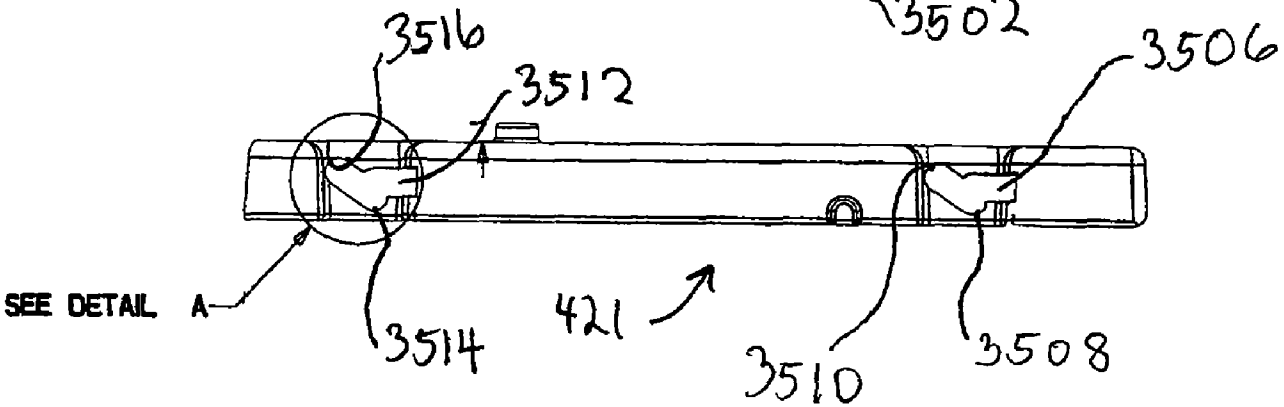
FIG. 25 illustrates a side elevation view of the brake lifter of FIG. 24, according to embodiments of the present invention.
Figure 30:
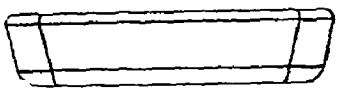
FIG. 30 illustrates a front elevation view of the arm pivot support of FIGS. 27-29, according to embodiments of the present invention.
Figure 27:
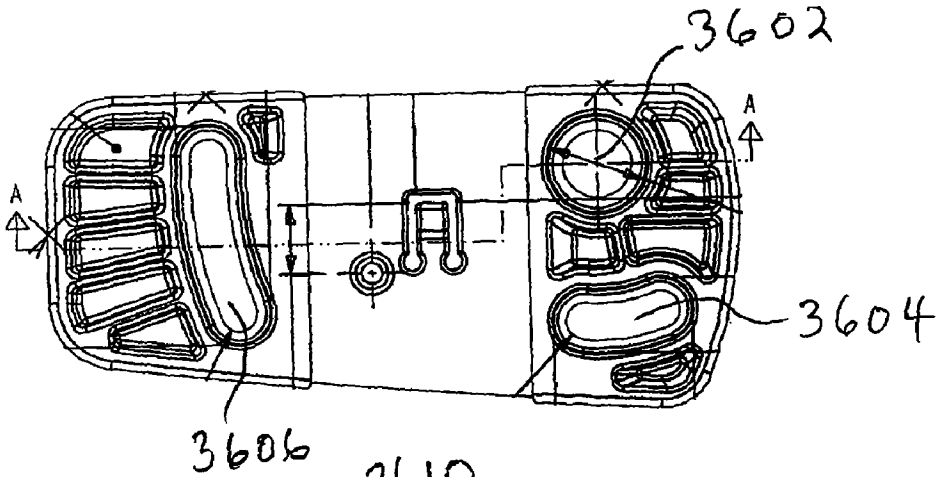
FIG. 27 illustrates a top plan view of an arm pivot support, according to embodiments of the present invention.
Figure 28:
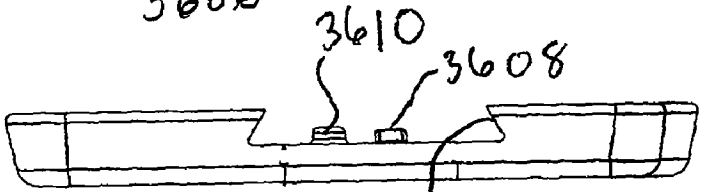
FIG. 28 illustrates a side elevation view of the arm pivot support of FIG. 27, according to embodiments of the present invention.

The arm brake assembly 417 may be lifted by arm brake lifter 421, according to embodiments of the present invention. Arm brake lifter 421 may be placed on top of arm depth slider 415 between ridges 2830, such that post 3502 extends within a gap 2832 between ridges 2830 and post 3504 extends within another gap 2834 between ridges 2830 (see FIG. 12), according to embodiments of the present invention. Forward or backward sliding of arm brake lifter 421 may thus be limited by the posts 3502, 3504 abutting the ridges 2830 at the front or back of gaps 2832, 2834, respectively. The forward posts 3110 of arm brake assembly 417 extend within slots 3506 of arm brake lifter 421, and the rearward posts 3112 of arm brake assembly 417 extend within slots 3512 of arm brake lifter 421 (see FIGS. 24-25), according to embodiments of the present invention. When the arm brake assembly 417 is in the downward or "locked" configuration, posts 3110 rest within a trough 3508 of slot 3506, and posts 3112 likewise rest within a trough 3514 of slot 3512, according to embodiments of the present invention. When the arm brake lifter 421 is slid forward along arm depth slider 415, the shape of slots 3506, 3512 causes a corresponding vertical displacement of posts 3110, 3112 which lifts the arm brake assembly 417. In other words, in a lifted or "unlocked" position, arm brake lifter 421 has been slid forward causing posts 3110 to be pushed toward or against the upper end 3510 of slot 3506 and causing posts 3112 to be pushed toward or against the upper end 3516 of slot 3512. According to such embodiments of the present invention, slots 3506, 3512 act as ramps to lift the arm brake assembly 417 vertically as the arm brake lifter 421 is slid horizontally.

Figure 42:
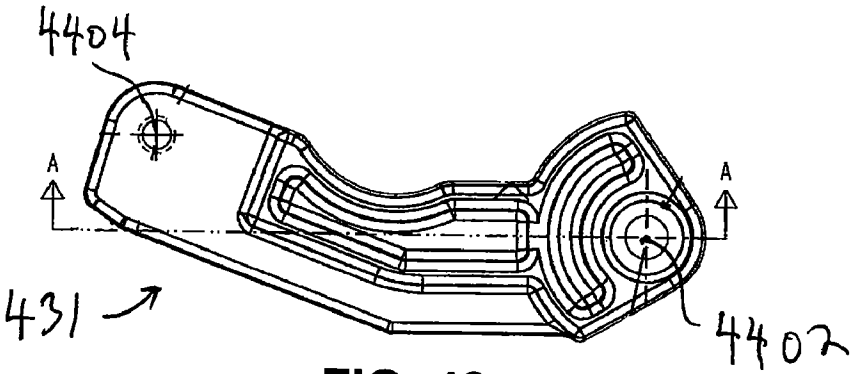
FIG. 42 illustrates a top plan view of an arm link, according to embodiments of the present invention.
Figure 43:
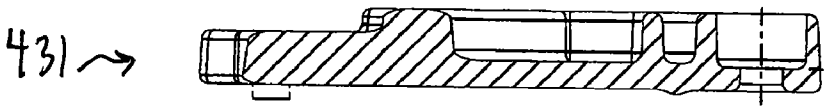
FIG. 43 illustrates a cross-sectional view of the arm link of FIG. 42, taken along line A-A of FIG. 42, according to embodiments of the present invention.
Figure 44:
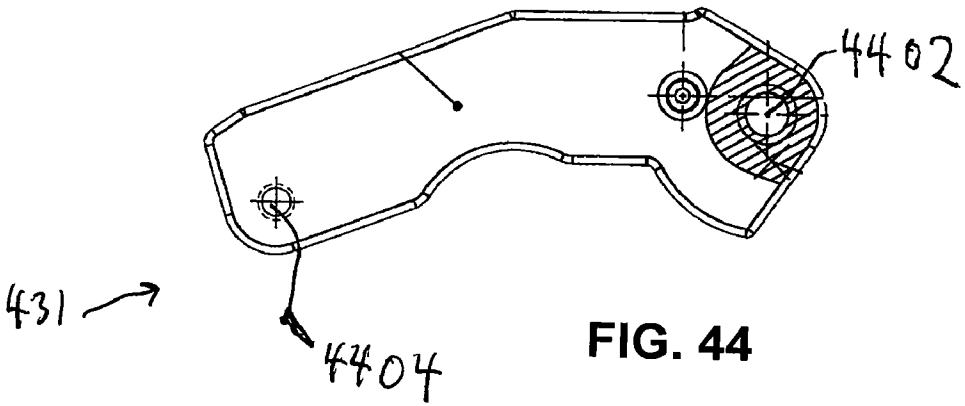
FIG. 44 illustrates a bottom plan view of the arm link of FIGS. 42-43, according to embodiments of the present invention.
Figure 53:
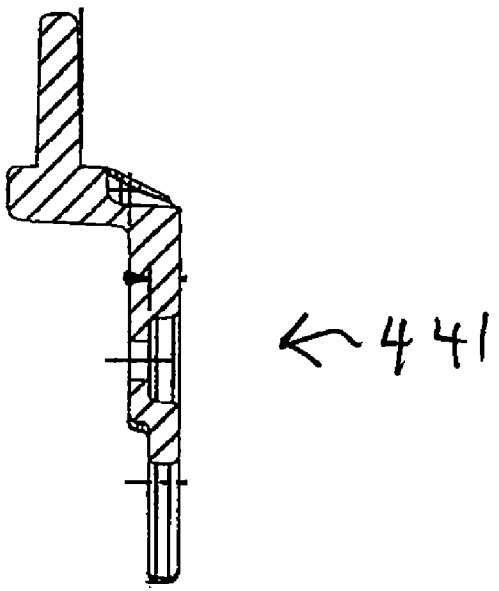
FIG. 53 illustrates a cross-sectional view of the arm button link of FIG. 52, taken along line A-A of FIG. 52, according to embodiments of the present invention.
Figure 52:
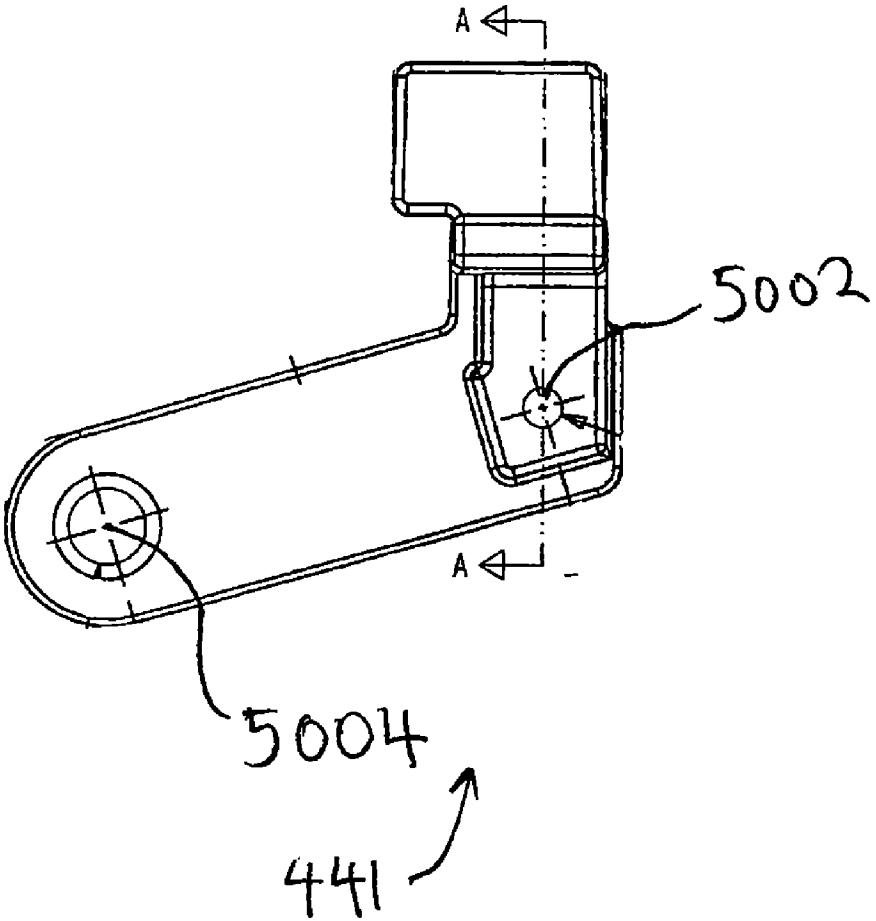
FIG. 52 illustrates a top plan view of an arm button link, according to embodiments of the present invention.

The forward sliding of the arm brake lifter 421 may be imparted by a "toggle lock" type mechanism activated by the arm button 439, and as illustrated in FIGS. 54-58. Arm link 431 may be pivotably coupled to arm depth slider 415 by an attachment device such as, for example, by screw 281 placed through hole 4402 (see FIGS. 42-45) and then into arm depth slider 415 at pivot point 2812 (see FIG. 12). Arm button link 441 may be pivotably coupled to the top of arm brake lifter 421 at pivot point 3520 by an attachment device such as, for example, by screw 300 placed through a washer and then through hole 5004 (see FIGS. 52-53) and into arm brake lifter 421 at pivot point 3520 (see FIG. 24). Arm link 431 may be pivotably coupled with arm button link 441 by pivotably coupling pivot point 4404 with pivot point 5002 (see FIGS. 42, 52), according to embodiments of the present invention. Because arm button link 441 is linked to arm button 439, pushing the arm button 439 inwardly causes a sliding movement of arm brake lifter 421 and corresponding lifting of the arm brake assembly 417, as illustrated in FIGS. 54-58.

Thus, the button 439 activates this "toggle lock" type mechanism to release the rubber clutch pad 419. Such a "toggle lock" type mechanism is beneficial, according to embodiments of the present invention, because the force to hold the button 439 in as the pad 419 is adjusted is lower than the initial force to activate. Activating the button 439 allows the arm to move fore/aft and left/right in a substantially horizontal plane.

As such, embodiments of the present invention include a compact set of mechanisms within a chair arm to permit a swiveling and/or pivoting motion of the arm pad assembly 427 in a substantially horizontal plane and a translation motion of the arm pad assembly 427 in both forward-and-backward and side-to-side directions in a substantially horizontal plane. According to other embodiments of the present invention, the slot 3614 in arm pivot support 423 into which arm width slider 425 may be inserted is curved, and/or the arm width slider 425 is curved or otherwise adapted, such that lifting the brake assembly 417 permits the arm pad to be moved through an arc substantially in the horizontal plane. According to other embodiments of the present invention, the arm pivot support 423 and/or arm width slider 425 may be similarly adapted to permit the armpad to slide forward and outward at the same time, once brake assembly 417 has been lifted.

According to embodiments of the present invention, brake 419 and/or the top of arm pivot support 423 may include materials and/or structures which cause them to substantially inhibit movement of the pad assembly 427 when the brake 419 contacts the arm pivot support 423 and substantially permit movement of the pad assembly 427 when the brake 419 has been lifted away from arm pivot support 423. For example, the brake 419 and/or the arm pivot support 423 may be constructed of a rubber material or other such material which creates resistance to movement due to friction. The brake 419 and/or arm pivot support 423 may also feature, according to embodiments of the present invention, a mild protrusion which interfaces with a mild indentation to substantially inhibit arm pad assembly 427 movement in the locked position. According to yet other embodiments of the present invention, the brake 419 and/or the arm pivot support 423 may include one harder surface with small protrusions, spikes, or bumps which are configured to interface with and/or embed within a softer surface to substantially inhibit arm pad assembly 427 movement in the locked position.

Figure 54:
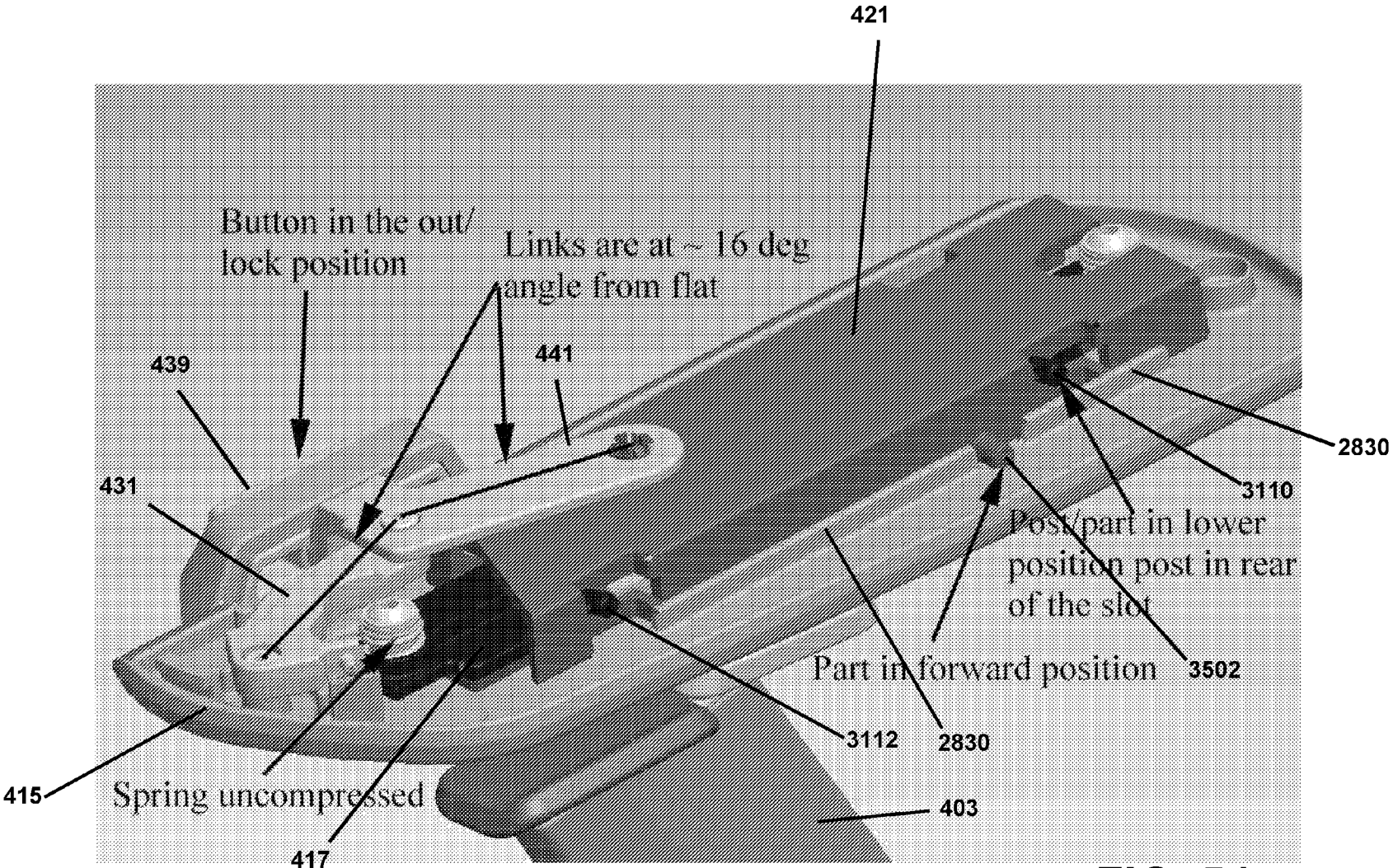
FIG. 54 illustrates a top perspective view of a chair arm adjustment mechanism in a locked position, according to embodiments of the present invention.
Figure 55:
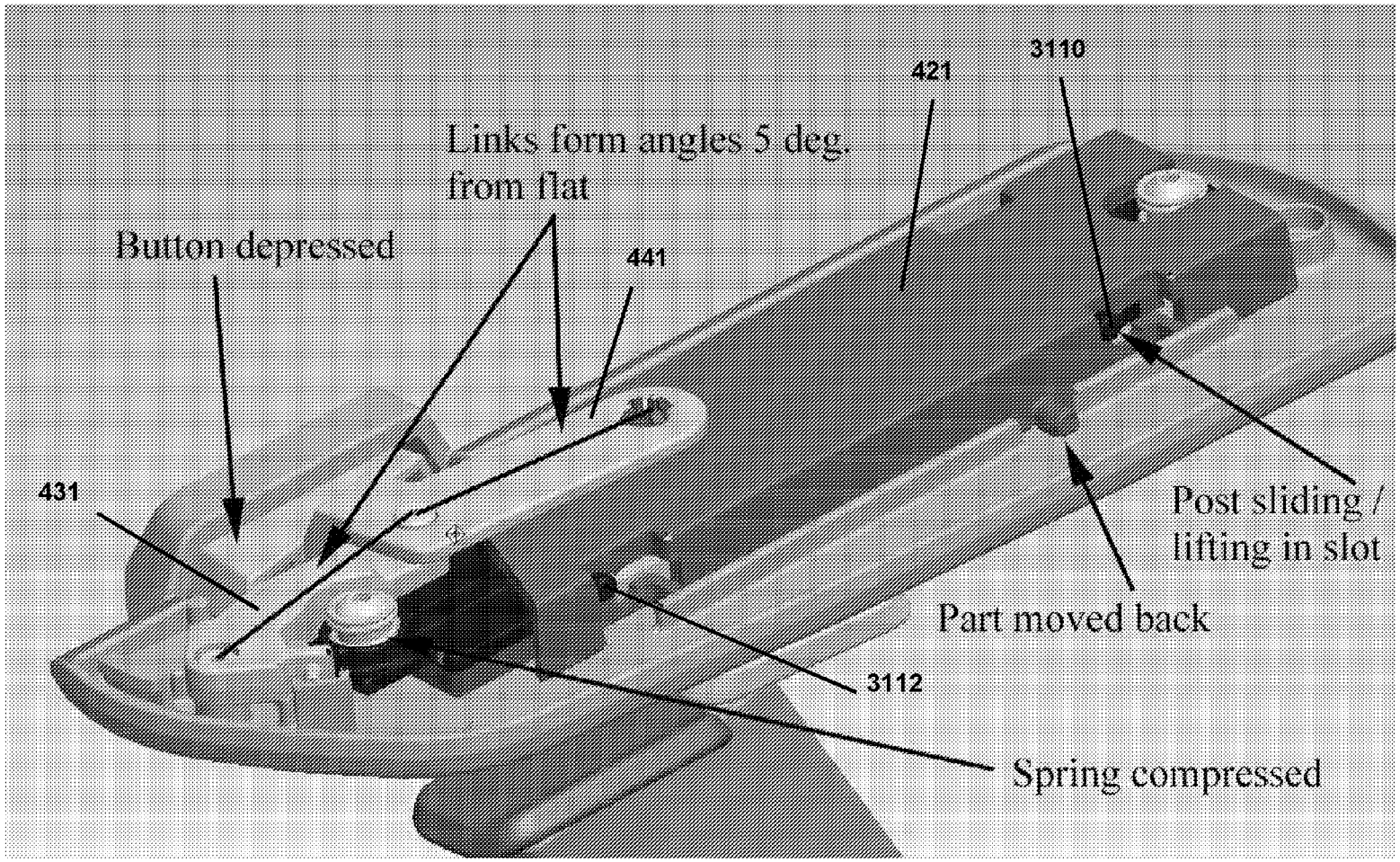
FIG. 55 illustrates a top perspective view of the chair arm adjustment mechanism of FIG. 54 in an unlocked position, according to embodiments of the present invention.

FIG. 54 illustrates a top perspective view of a chair arm adjustment mechanism in a locked position, according to embodiments of the present invention. The button 439 is in the out or locked position, and the links 431, 441 are at approximately sixteen degrees angle from flat (e.g. the links 431, 441 have an angle formed between them of approximately one hundred sixty-four degrees), according to embodiments of the present invention. The springs are uncompressed, the post 3502 is in a forward position, and the posts 3110, 3112 are in the lower position in which the posts 3110, 3112 are in the rear of the slots, according to embodiments of the present invention. FIG. 55 illustrates a top perspective view of the chair arm adjustment mechanism of FIG. 54 in an unlocked position, according to embodiments of the present invention. In the unlocked position, the button 439 is depressed, the links form angles of approximately five degrees from flat (e.g. the links 431, 441 have an angle formed between them of approximately one hundred seventy-five degrees), according to embodiments of the present invention. The post 3502 is moved back, the spring is compressed, and the posts 3110, 3112 have slid and lifted in the slots within the brake lifter 421, according to embodiments of the present invention.

Figure 56:
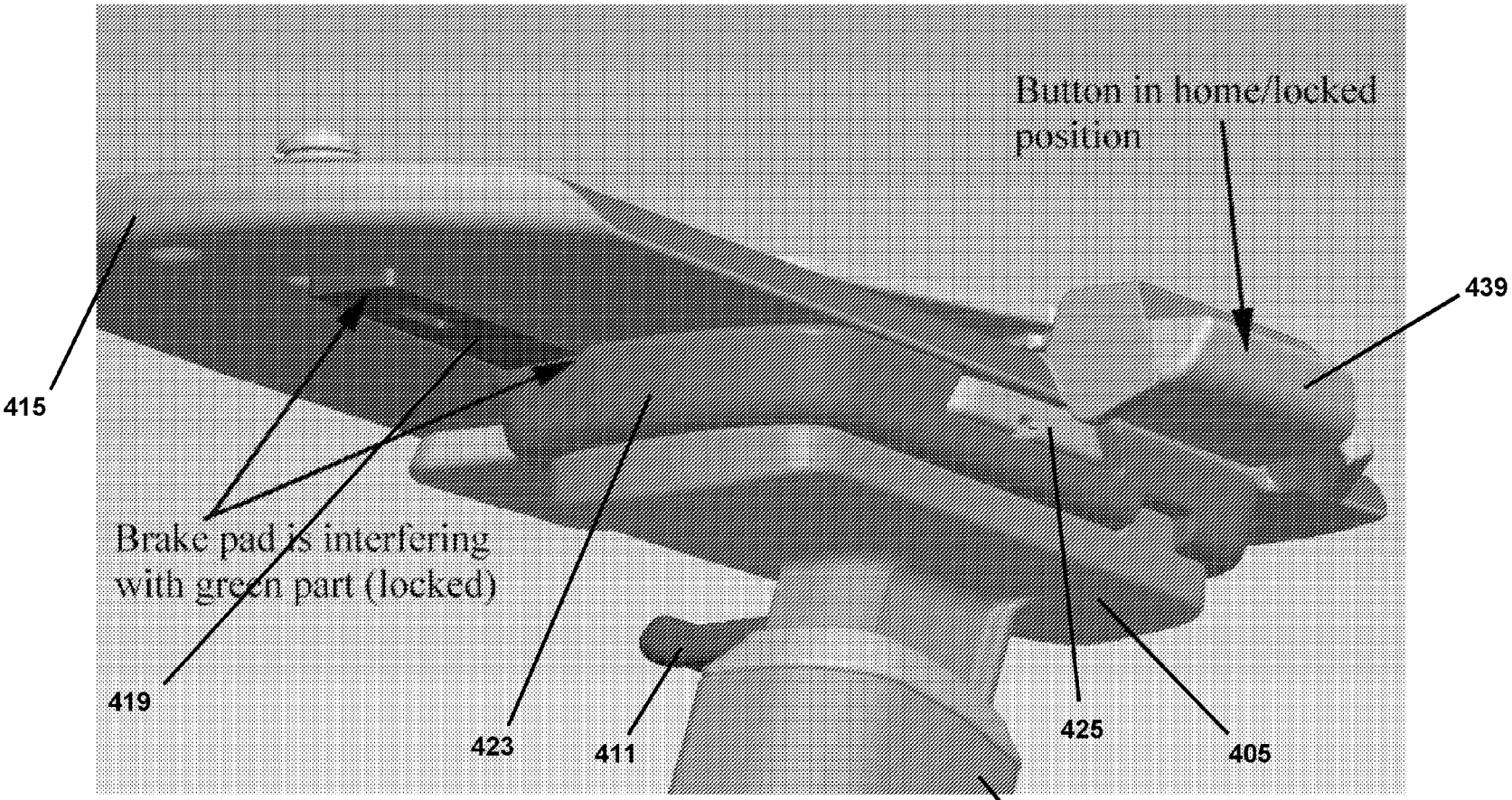
FIG. 56 illustrates a bottom perspective view of the chair arm adjustment mechanism of FIGS. 54-55 in a locked position, according to embodiments of the present invention.
Figure 57:
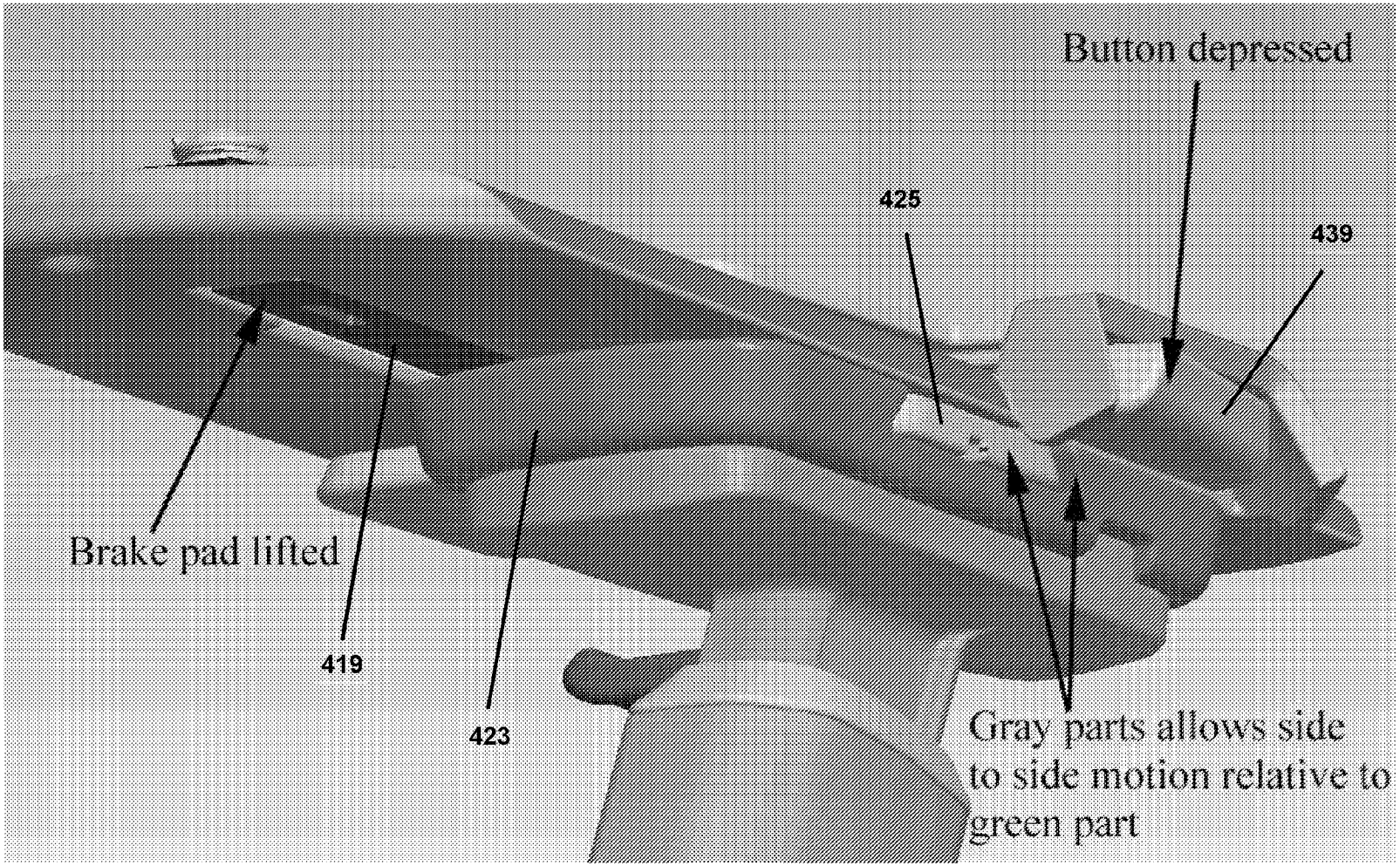
FIG. 57 illustrates a bottom perspective view of the chair arm adjustment mechanism of FIGS. 54-56 in an unlocked position, according to embodiments of the present invention.
Figure 58:
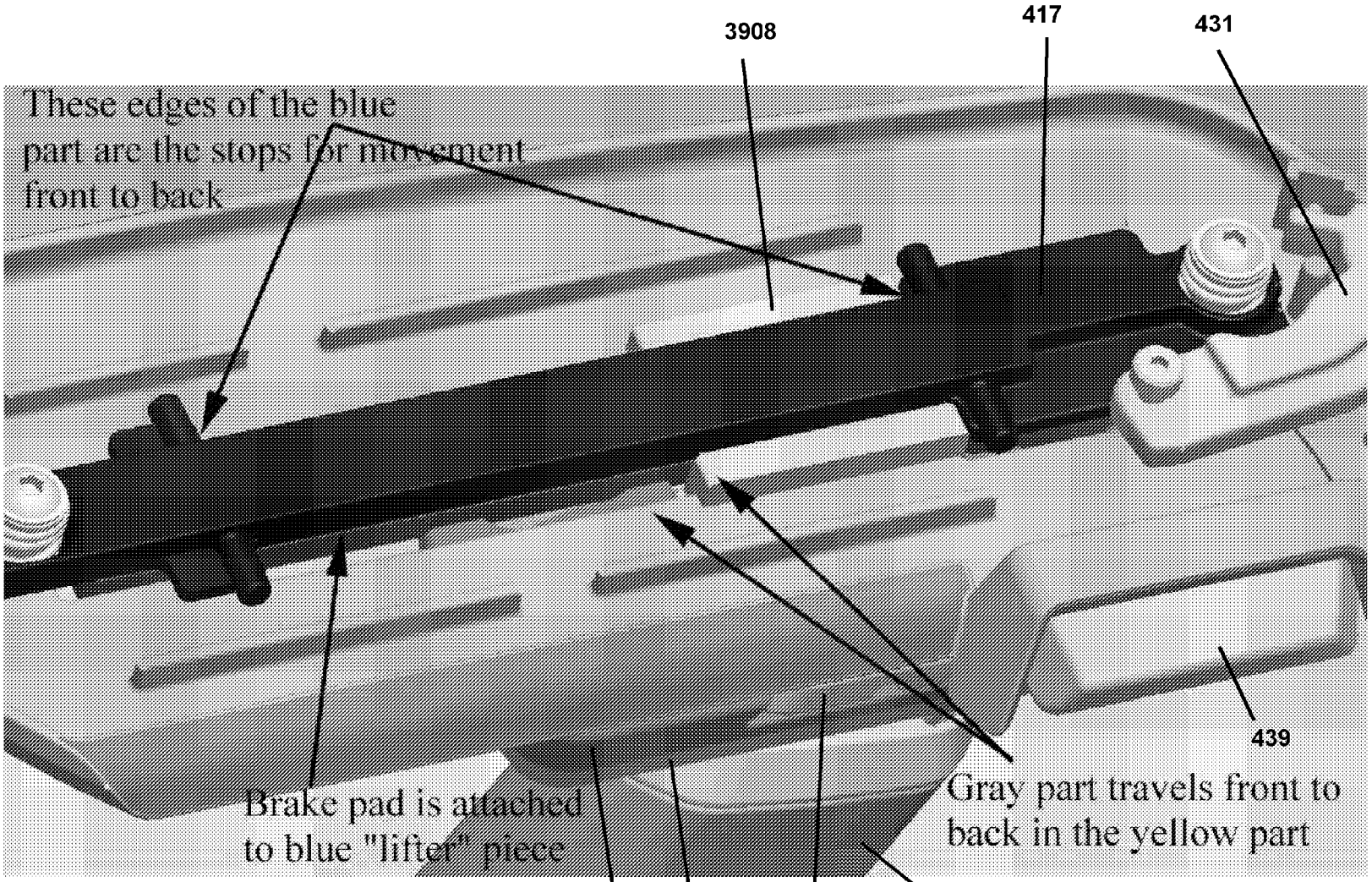
FIG. 58 illustrates a chair arm adjustment mechanism with the brake lifter removed, according to embodiments of the present invention.

FIG. 56 illustrates a bottom perspective view of the chair arm adjustment mechanism of FIGS. 54-55 in a locked position, according to embodiments of the present invention. In the locked position, the button 439 is in the "home" or locked position, and the brake pad 419 interferes with the arm pivot support 423. FIG. 57 illustrates a bottom perspective view of the chair arm adjustment mechanism of FIGS. 54-56 in an unlocked position, according to embodiments of the present invention. In the unlocked position, the button 439 is depressed, the brake pad 419 is lifted with respect to the arm pivot support 423, and the width slider 425 slides freely with respect to the arm pivot support 423 and the arm depth slider 415 slides freely with respect to the width slider 425, according to embodiments of the present invention. FIG. 58 illustrates a chair arm adjustment mechanism in a locked position with the brake lifter removed, according to embodiments of the present invention. In the unlocked position, the pair of prongs 3908 slide over rails on the arm depth slider 415, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A chair arm adjustment device, comprising:

an arm support;

an arm pad base slidably coupled to the arm support, the arm pad base configured to slide substantially horizontally in two degrees of freedom with respect to the arm support within a range of motion of the arm pad base with respect to the arm support;

an arm brake assembly coupled with the arm pad base, the arm brake assembly moveable between a locked position in which the arm brake assembly substantially inhibits movement of the arm pad base with respect to the arm support and an unlocked position in which the arm brake assembly does not substantially inhibit movement of the arm pad base with respect to the arm support, wherein the arm brake assembly is operable to move from the unlocked position to the locked position at any position of the arm pad base within the range of motion; and a width slider slidably coupled to the arm support, the width slider configured to slide back and forth substantially horizontally with respect to the arm support along a first direction, wherein the arm pad base is slidably coupled to the width slider, the arm pad base configured to slide back and forth substantially horizontally with respect to the width slider along a second direction different from the first direction.

2. The chair arm adjustment device of claim 1, wherein the first direction is substantially perpendicular to the second direction.

3. A chair arm adjustment device, comprising:

an arm support;

an arm pad base slidably coupled to the arm support, the arm pad base configured to slide substantially horizontally in two degrees of freedom with respect to the arm support within a range of motion of the arm pad base with respect to the arm support;

an arm brake assembly coupled with the arm pad base, the arm brake assembly moveable between a locked position in which the arm brake assembly substantially inhibits movement of the arm pad base with respect to the arm support and an unlocked position in which the arm brake assembly does not substantially inhibit movement of the arm pad base with respect to the arm support, wherein the arm brake assembly is operable to move from the unlocked position to the locked position at any position of the arm pad base within the range of motion; and a brake lifter having at least one ramp opening, the at least one ramp opening comprising at least one ramp, wherein the arm brake assembly comprises at least one post protruding through the at least one ramp opening, and wherein sliding the brake lifter in a substantially horizontal direction raises the at least one post along the at least one ramp to move the arm brake assembly from the locked position to the unlocked position.

4. The chair arm adjustment device of claim 3, further comprising:

at least one spring biasing the arm brake assembly toward the locked position.

5. The chair arm adjustment device of claim 4, further comprising:

an arm link pivotably coupled to the arm pad base at a first pivot axis;

a button link comprising a button, the button link pivotably coupled to the arm link at a second pivot axis and pivotably coupled to the brake lifter at a third pivot axis, wherein pushing the button widens an angle formed by the first, second, and third pivot axes to slide the brake lifter in the substantially horizontal direction.

6. A chair arm adjustment device, comprising:

an arm support;

an arm pad base slidably coupled to the arm support, the arm pad base configured to slide substantially horizontally in two degrees of freedom with respect to the arm support within a range of motion of the arm pad base with respect to the arm support;

an arm brake assembly coupled with the arm pad base, the arm brake assembly moveable between a locked position in which the arm brake assembly substantially inhibits movement of the arm pad base with respect to the arm support and an unlocked position in which the arm brake assembly does not substantially inhibit movement of the arm pad base with respect to the arm support, wherein the arm brake assembly is operable to move from the unlocked position to the locked position at any position of the arm pad base within the range of motion; and an arm base, wherein the arm support pivots about the arm base through two or more discrete pivot angles.

7. A chair arm adjustment device, comprising:

an arm support;

an arm pad base slidably coupled to the arm support, the arm pad base configured to slide substantially horizontally in two degrees of freedom with respect to the arm support within a range of motion of the arm pad base with respect to the arm support; and an arm brake assembly coupled with the arm pad base, the arm brake assembly moveable between a locked position in which the arm brake assembly substantially inhibits movement of the arm pad base with respect to the arm support and an unlocked position in which the arm brake assembly does not substantially inhibit movement of the arm pad base with respect to the arm support, wherein the arm brake assembly is operable to move from the unlocked position to the locked position at any position of the arm pad base within the range of motion, wherein the arm brake assembly contacts the arm support in the locked position, and wherein the arm brake assembly does not contact the arm support in the unlocked position.

8. The chair arm adjustment device of claim 7, further comprising:

a biasing element configured to push the arm brake assembly toward the arm support.

9. The chair arm adjustment device of claim 8, wherein the biasing element is one or more springs.

10. A chair arm adjustment device, comprising:

an arm base;

an arm support pivotably coupled to the arm base;

a slider slidably coupled to the arm support, the slider configured to slide substantially horizontally along a first direction;

an arm pad base slidably coupled to the slider, the arm pad base configured to slide substantially horizontally along a second direction with respect to the slider, the second direction substantially perpendicular to the first direction, the arm pad base configured to slide substantially horizontally simultaneously in the first and second directions with respect to the arm support; and an arm brake assembly coupled with the arm pad base, the arm brake assembly moveable between a locked position in which the arm brake assembly substantially inhibits sliding of the arm pad base with respect to the arm support and an unlocked position in which the arm brake assembly does not substantially inhibit sliding of the arm pad base with respect to the arm support, wherein the arm brake assembly is operable to move from the unlocked position to the locked position at an unlimited number of positions of the arm pad base with respect to the arm support.

11. The chair arm adjustment device of claim 10, wherein the arm pad base slides with respect to the arm support within a range of motion, and wherein the arm brake assembly is operable to move from the unlocked position to the locked position in an infinite number of positions of the arm pad base with respect to the arm support within the range of motion.

12. The chair arm adjustment device of claim 10, wherein the arm brake assembly is operable to move from the locked position to the unlocked position in an infinite number of positions of the arm pad base with respect to the arm support.

13. A chair arm adjustment device, comprising:

an arm support;

an arm pad base coupled to the arm support, the arm pad base moveable with respect to the arm support in any direction along a plane;

an arm brake assembly coupled with the arm pad base, the arm brake assembly moveable between a locked position in which the arm brake assembly interferes with the arm support to substantially inhibit sliding of the arm pad base with respect to the arm support and an unlocked position in which the arm brake assembly does not substantially interfere with sliding of the arm pad base with respect to the arm support, wherein the arm brake assembly is operable to move from the unlocked position to the locked position at an unlimited number of positions of the arm pad base with respect to the arm support;

a button;

a brake lifter, the brake lifter comprising at least one ramp opening with at least one ramp, wherein the arm brake assembly comprises at least one post extending through the at least one ramp opening and wherein sliding the brake lifter raises the at least one post along the at least one ramp to move the arm brake assembly from the locked position to the unlocked position; and a means for sliding the brake lifter in response to a push of the button.

14. A chair arm adjustment device, comprising:

an arm support;

an arm pad base coupled to the arm support, the arm pad base moveable with respect to the arm support in any direction along a plane;

an arm brake assembly coupled with the arm pad base, the arm brake assembly moveable between a locked position in which the arm brake assembly interferes with the arm support to substantially inhibit sliding of the arm pad base with respect to the arm support and an unlocked position in which the arm brake assembly does not substantially interfere with sliding of the arm pad base with respect to the arm support, wherein the arm brake assembly is operable to move from the unlocked position to the locked position at an unlimited number of positions of the arm pad base with respect to the arm support;

a brake lifter, the brake lifter comprising at least one ramp opening with at least one ramp, wherein the arm brake assembly comprises at least one post extending through the at least one ramp opening and wherein sliding the brake lifter raises the at least one post along the at least one ramp to move the arm brake assembly from the locked position to the unlocked position;

a button linkage comprising a button, the button linkage pivotably coupled to the brake lifter at a first pivot point; and an arm linkage pivotably coupled to the button linkage at a second pivot point and pivotably coupled to the arm pad base at a third pivot point, wherein an obtuse angle is formed by the first, second, and third pivot points such that pushing the button slides the brake lifter.

15. The chair arm adjustment device of claim 14, wherein the arm pad base is coupled to the arm support by a slider.

16. The chair arm adjustment device of claim 14, further comprising an arm base, wherein the arm support pivots about the arm base.

17. A chair arm adjustment device, comprising:

an arm support;

an arm pad base coupled to the arm support, the arm pad base moveable with respect to the arm support in any direction along a plane;

an arm brake assembly coupled with the arm pad base, the arm brake assembly moveable between a locked position in which the arm brake assembly interferes with the arm support to substantially inhibit sliding of the arm pad base with respect to the arm support and an unlocked position in which the arm brake assembly does not substantially inhibit sliding of the arm pad base with respect to the arm support, wherein movement of the arm brake assembly from the locked position to the unlocked position is a substantially vertical movement;

an arm brake lifter, wherein sliding the arm brake lifter substantially horizontally moves the arm brake assembly from the locked position to the unlocked position;

a button linkage assembly pivotably coupled to the arm brake lifter and to the arm pad base, the button linkage assembly comprising a button, wherein pushing the button causes the button linkage assembly to slide the arm brake lifter, and wherein an amount of force to depress the button decreases as the arm brake assembly moves from the locked position to the unlocked position.

18. The chair arm adjustment device of claim 17, wherein the arm brake assembly is operable to move from the unlocked position to the locked position at an unlimited number of positions of the arm pad base with respect to the arm support.

* * * * *